United States Patent [19]

Siegel et al.

[11] 4,411,725

[45] * Oct. 25, 1983

[54] DAYLIGHT FILM SPLICER

[75] Inventors: John H. Siegel, Bellevue; Gerald L. Edwards, Seattle, both of Wash.

[73] Assignee: CX Corporation, Seattle, Wash.

[ * ] Notice: The portion of the term of this patent subsequent to May 25, 1999, has been disclaimed.

[21] Appl. No.: 839,603

[22] Filed: Oct. 5, 1977

[51] Int. Cl.[3] ..... G03D 15/04

[52] U.S. Cl. ..... 156/353; 156/159; 156/368; 156/381; 156/384; 156/502; 156/506; 156/510; 156/518; 156/543; 156/351; 242/59; 354/310; 354/314; 226/92

[58] Field of Search ..... 156/159, 267, 304.3, 156/304.6, 381, 502, 505, 506, 510, 538, 539, 543, 518, 353, 384, 361, 368; 242/58.5, 59; 354/307, 310, 314

[56] References Cited

U.S. PATENT DOCUMENTS

| | | | |
|---|---|---|---|
| 3,577,302 | 5/1971 | Szakacs | 156/506 |
| 3,687,751 | 8/1972 | Cumbo et al. | 156/159 |
| 3,779,837 | 12/1973 | Zahn et al. | 156/159 |
| 3,925,143 | 12/1975 | Aldo | 156/506 |
| 4,080,242 | 3/1978 | Komenda et al. | 156/506 |
| 4,094,723 | 6/1978 | Jones | 156/506 |
| 4,094,726 | 6/1978 | Hujer et al. | 156/502 |

*Primary Examiner*—Michael G. Wityshyn

*Attorney, Agent, or Firm*—Christensen, O'Connor, Johnson & Kindness

[57] ABSTRACT

An apparatus for unloading a length of film from a cartridge, trimming the ends from the film, splicing the leading edge of the film to the trailing edge of the previously unloaded film, placing an identifying mark on the film and on an envelope and winding the film on a magazine. The unloading device allows the film to be removed from the cartridge by manually pulling the sheet of backing paper from the film in the daylight while shielding the film from light. The cartridge is locked to the loading device until all of the film in the cartridge has been loaded through a film guide into a storage box. The leading edge of the film is then trimmed by upward movement of a cutting blade allowing the film to advance through an aperture in the cutting blade until the trailing edge is trimmed by downward movement of the cutting blade. The splicer for securing the film to the previously unloaded film includes a heated press for applying heat and pressure to the film and to a length of conventional heat seal tape which is selectively fed from a reel positioned to one side of the film guide. An identifying number is then photographically recorded on the film while the same number is being printed on an envelope to insure proper registry of the film and envelope. The position of the film at various points is detected by infrared sensors, and the film is moved by stepping motors which are actuated by a microprocessor based control system responsive to inputs from the position sensors.

17 Claims, 38 Drawing Figures

C
172
30
P
F
36b
36a
28
32
10
38
108
176
102b
102a
44
184
42
11
152
148
150
24
154
146
140
144
142
26
34
48
186
188
180
49
50
182
32a
160
162
164

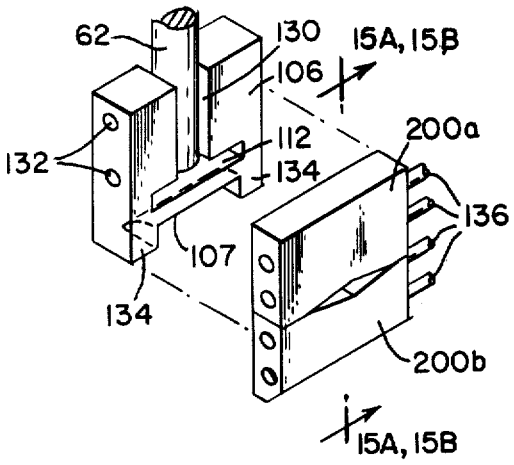
FIG. 14
FIG. 15A FIG. 15B
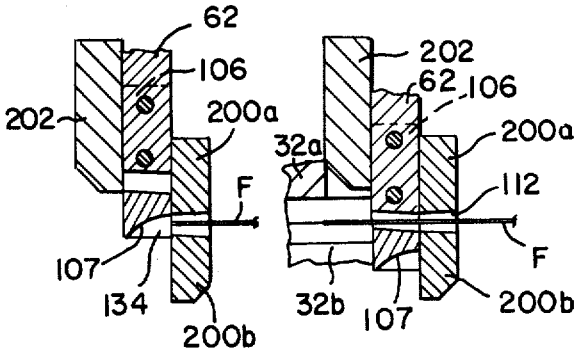
FIG. 16
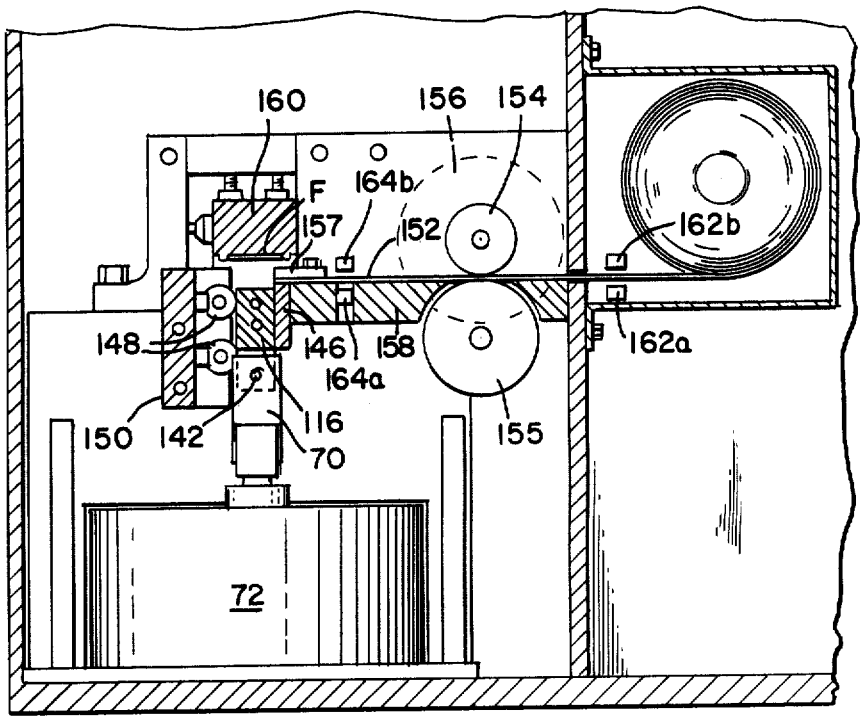

HALF STEP SEQUENCE TABLE
( X = SWITCH CLOSED)

| STEP | + A | − A | + B | − B |
|---|---|---|---|---|
| 0 | X | | X | |
| 1/2 | X | | | |
| 1 | X | | | X |
| 1 1/2 | | | | X |
| 2 | | X | | X |
| 2 1/2 | | X | | |
| 3 | | X | X | |
| 3 1/2 | | | X | |
| 4 | X | | X | |

REVERSE ↑ FORWARD ↓

HALF STEP SEQUENCE TABLE
X = SWITCH CLOSED

| STEP | + A | − A | RESET A | + B | − B | RESET B |
|---|---|---|---|---|---|---|
| 0 | X | | | X | | |
| 1/2 | X | | | | | X |
| 1 | X | | | | X | |
| 1 1/2 | | | X | | X | |
| 2 | | X | | | X | |
| 2 1/2 | | X | | | | X |
| 3 | | X | | X | | |
| 3 1/2 | | | X | X | | |
| 4 | X | | | X | | |

REVERSE ↑ FORWARD ↓

THIS PROGRAM CHECKS MACHINE STATUS FIRST BY MONITORING THE LIGHT DETECTOR TO DETERMINE IF A LEAK HAS OCCURRED. NEXT BY MONITORING THE TEMPERATURE OF THE HEATED HEAD, AND THIRD BY DETERMINING IF THERE IS SPLICE TAPE. IF NOT, THE OPERATOR IS SUMMONED AND IS ABLE TO RELOAD SPLICE TAPE. THIS ERROR ANALYSIS OCCURS BEFORE READY IS DISPLAYED.

THIS PROGRAM MONITORS THE KEYBOARD AND IS ENTERED BY DEPRESSING THE TEST KEY. THEN 2 NUMBERS ARE ENTERED AND CORRESPONDING ACTION TAKEN.

THIS PROGRAM ALLOWS FILM TO BE ENTERED IN MACHINE AND SPLICED ONTO EITHER ANOTHER ROLL OF FILM OR LEADER ALREADY IN THE MACHINE. IT THEN ALIGNS FILM TO SPLICE AREA ALLOWING ANOTHER ROLL OF FILM OR LEADER TO BE SPLICED ONTO IT. IT ALSO PRINTS THE TWIN CHECK NUMBER ONTO THE ENVELOPE AND EXPOSES THE TWIN CHECK NUMBER ON THE FILM.

THESE PROGRAMS ALLOW DATA ENTRY INTO THESE THREE AREAS.

FIG. 31

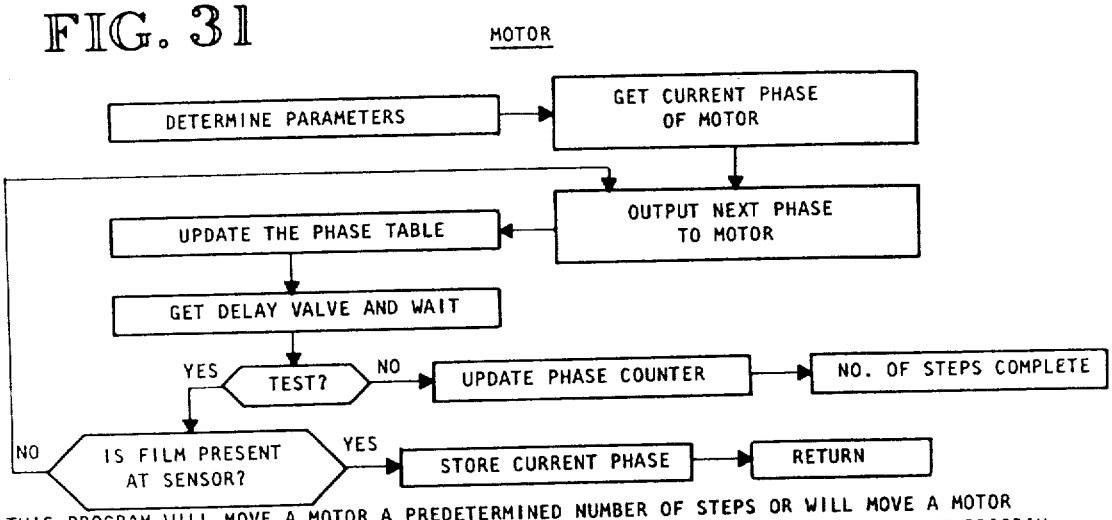

THIS PROGRAM WILL MOVE A MOTOR A PREDETERMINED NUMBER OF STEPS OR WILL MOVE A MOTOR UNTIL A TEST CONDITION IS MET SUCH AS A FILM ARRIVING AT A CERTAIN POINT. THE PROGRAM SELECTS WHICH MOTOR TO MOVE AND BY A TABLE WILL ACCELERATE AND DECELERATE THE MOTOR IN AN EXPONENTIAL MANNER SO THAT A FULL SPEED OF 25 INCHES PER SECOND OF FILM TRAVEL CAN BE REACHED.

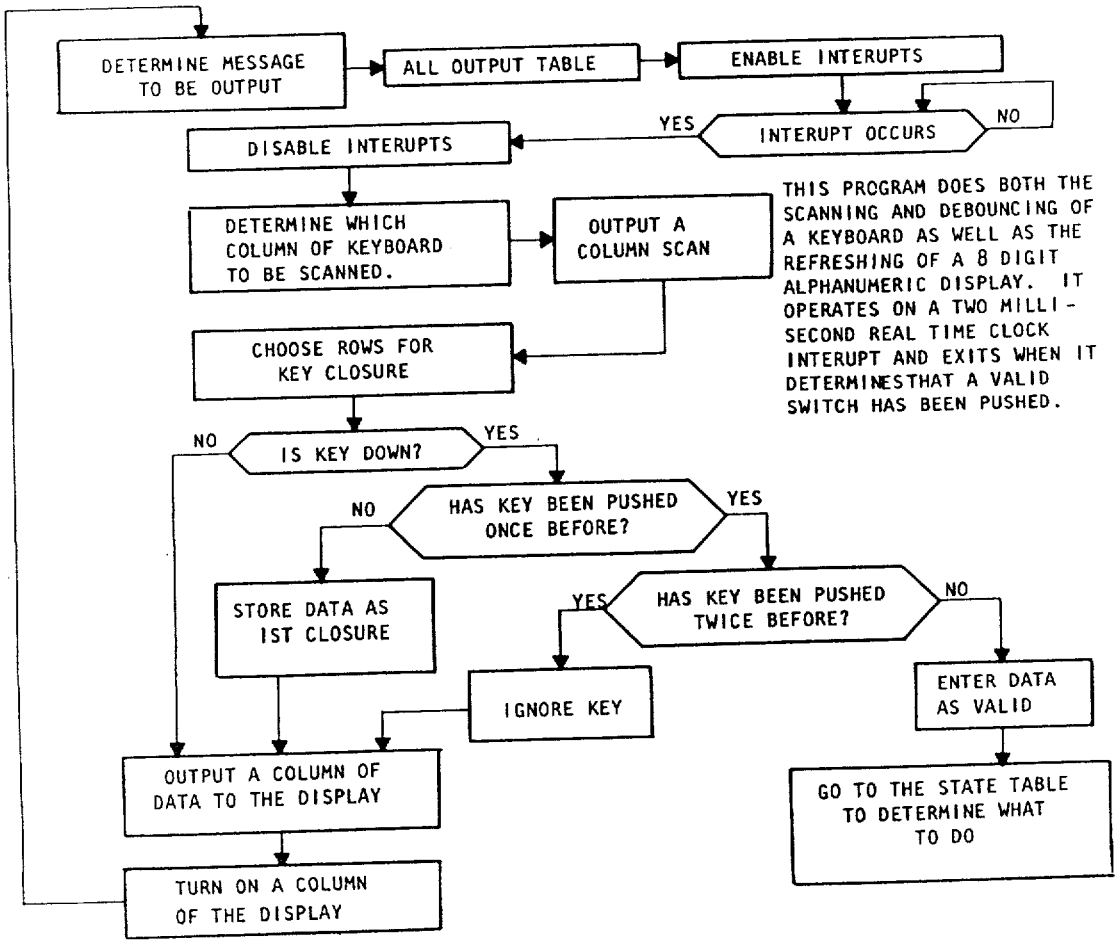

THIS PROGRAM DOES BOTH THE SCANNING AND DEBOUNCING OF A KEYBOARD AS WELL AS THE REFRESHING OF A 8 DIGIT ALPHANUMERIC DISPLAY. IT OPERATES ON A TWO MILLI-SECOND REAL TIME CLOCK INTERUPT AND EXITS WHEN IT DETERMINESTHAT A VALID SWITCH HAS BEEN PUSHED.

THIS PROGRAM ALLOWS A LEADER OF ANY LENGTH TO BE ENTERED INTO THE MACHINE. IT IS WOUND ON THE TAKE-UP REEL AND IS THEN ALIGNED TO THE SPLICE AREA READY FOR THE FILM TO BE ENTERED.

THIS PROGRAM ALLOWS LEADER OF ANY LENGTH TO BE ENTERED INTO THE MACHINE AND SPLICED ONTO LIVE FILM ALREADY IN THE MACHINE. IT IS THEN ALIGNED TO THE SPLICE AREA READY FOR FILM TO BE ENTERED.

THIS PROGRAM ALLOWS LEADER TO BE ENTERED INTO THE MACHINE AND SPLICED INTO THE END OF A REEL OF LIVE FILM. THEN THE OPERATOR REMOVES THE REEL AND STARTS AGAIN WITH MORE LEADER.

DAYLIGHT FILM SPLICER

BACKGROUND OF THE INVENTION

1. Field of the Invention

This invention relates to film splicers, and more particularly to a film splicer which unloads film from a cartridge in daylight, splices the ends of sequentially unloaded film to each other and applies an identifying mark to the film.

2. Description of the Prior Art

Film splicers for joining individual lengths of film end-to-end are in common use in the film processing industry. Although such splicers greatly improve the efficiency of film processing in comparison to processing individual lengths of film, they nevertheless suffer from a variety of problems.

The initial problem is encountered at the front end of the splicer when the film is being unloaded from a cartridge. In order to prevent the film from being inadvertently exposed during the unloading process, the splicer must generally be operated in a darkroom. Finally, when the spliced film has been wound on a film magazine it must be removed from the splicer in a darkroom in order to prevent inadvertent exposure of the film. The darkroom is far from an ideal working environment so that the efficiency of the operating personnel is somewhat limited. Consequently, the capacity of such splicers is significantly lower than the capacity would be if the operators were permitted to work in a properly illuminated environment.

In any film processing plant it is imperative that the film be properly identified so that the processed film is returned to the proper individual. In a large film processing lab this identification requirement is quite complex, and it is very difficult and time consuming to correct identification errors. The conventional procedure for film identification is to manually apply a gummed label to the film at the same time an identical label is applied to an envelope. After the film has been processed, the resulting slides or prints are then inserted in the correspondingly marked envelope and returned to the photographer. This procedure is somewhat time consuming and, since it involves human intervention, it is potentially error producing particularly in the darkroom environment.

In summary, the darkroom working environment coupled with the procedure for manually applying identifying markings to the film greatly reduces the throughput capacity of conventional film splicers and increases the possibility of film identification errors.

SUMMARY OF THE INVENTION

It is an object of the invention to provide a film splicer which can be loaded in a daylight environment.

It is another object of the invention to provide a film splicer which photographically places an internally generated identifying number on the film without operator intervention.

It is another object of the invention to provide a marking system for a film splicer which simultaneously places identical numbers on the film and on an envelope without operator intervention.

It is another object of the invention to provide a double acting cutter mechanism for trimming the ends of the film and for positively removing the resulting film chips from the cutter blade.

It is still another object of the invention to provide an optical film position sensor which is capable of sensing the presence of even clear, fully exposed film.

It is a further object of the invention to provide a splicing mechanism for automatically securing the leading edge of a length of film to the trailing edge of a previously loaded length of film.

These and other objects of the invention are accomplished by a film splicer in which the film is guided along a longitudinal film path. A loading mechanism at the front end of the film path includes an integral light shield for receiving film from a cartridge while shielding the film from external light. The film is loaded into the splicer by manually drawing the film backing paper from the cartridge. The loading mechanism includes locking means for maintaining the cartridge in position against the light shield until all of the film has been removed from the cartridge in order to prevent inadvertent exposure of the film. After all of the film has been loaded into the splicer, the leading end of the film is trimmed by the downward movement of a double acting cutting blade, and the film chip is subsequently carried from the film path. The film then advances through an aperture in the cutting blade until the trailing edge of the film is trimmed by upward movement of the double acting cutting blade, and the film chip is subsequently carried from the film path. The splicer then applied a conventional heat seal tape to the leading edge of the film and the trailing edge of the previously loaded film, and a splicing mechanism applies heat and pressure to the tape before trimming the tape to correspond to the width of the film. Finally, an internally generated identifying nummber is exposed on the film while the same number is simultaneously printed on an envelope containing the name and address of the intended recipient of the processed film. The movement of the film along the film guide is determined by infrared position sensors which are connected to a sensing circuit for stabilizing the characteristics of the position sensors responsive to environmental changes to allow the sensors to respond to relatively slight, short term changes in output produced by fully exposed film. The outputs of the position sensors are received by a microprocessor based control system which selectively advances the film and controls operation of the unloading mechanism, cutting mechansim, splicer and identification marker.

BRIEF DESCRIPTION OF THE FIGURES OF THE DRAWING

FIG. 14 is a detailed view of the cutting assembly of the splicer.

FIGS. 15A and 15B are cross-sectional views of a portion of the cutting assembly showing the position of the cutting blade in its raised and lowered positions, respectively.

FIG. 16 is a cross-sectional view transverse to the film guide showing the heat seal splicing tape infeed mechanism.

FIGS. 27, 28A, 28B, 29A, 29B, 30A, 30B, 31, 32A and 32B comprise a flow chart of the software for programming the central processing unit.

DETAILED DESCRIPTION OF THE INVENTION

Figure 1:
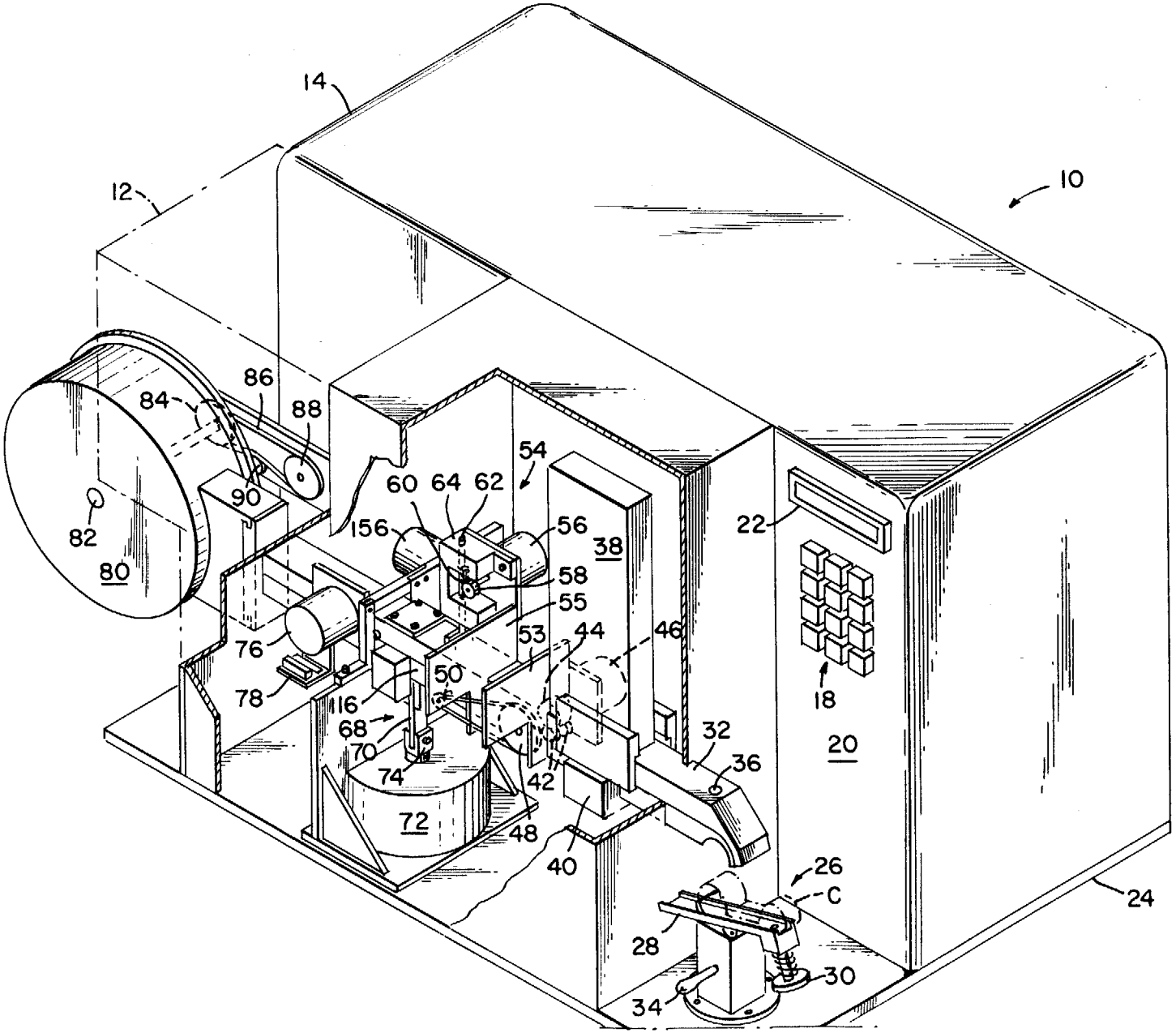
FIG. 1 is a fragmented isometric view of the entire film splicer.

As illustrated in FIG. 1, the splicer 10 includes a pair of interconnected housings 12, 14, one of which 12 encloses the film path and the other of which 14 encloses the splicer electronics. A keyboard 18 is mounted on a side panel 20 of the housing 14 beneath a conventional light emitting diode (LED) display 22. As explained hereinafter, the keyboard 18 is utilized to operate and program the splicer 10, and the display 22 indicates various operating conditions of the splicer.

The housings 12, 14 are mounted on a planar base 24. A film loading assembly 26 is secured to the upper surface of the base 24 adjacent the panel 20. As explained in detail hereinafter, the assembly 26 includes a support 28 for the film cartridge C, a violation plunger 30 for initially withdrawing the film backing paper from the cartridge C and a handle 34 for raising the cartridge support 28 to maintain the cartridge C in contact with an opening in the underside of a film track 32.

The upper surface of the film track 32 inside the housing 12 opens into a film storage box 38 which, as explained hereinafter, receives film from the cartridge C before it is processed by the splicer. A static discharge device 40 sold by Static, Inc. is mounted beneath the storage container 38 for removing static electricity from the film.

An optical position sensor 36 is mounted in the film track 32 for determining when all of the film has been removed from the cartridge C. Friction rollers 42, 44 are mounted on the film track 32 downstream from the storage box 38 and static electricity remover 40. The upper roller 44 is driven by a conventional stepping motor 46 for selectively advancing the film along the track 32. A pulley 48 rotating with the rollers 44 is connected to a downstream shaft 50 by a belt 52. A pair of infrared sensors mounted on respective circuit boards 53, 55 measure the position of the film F on opposite sides of the drive roller 44.

A film cutter assembly 54 is positioned downstream of the drive rollers 42, 44 to trim the leading and trailing edges from the film. The assembly 52 includes an actuating motor 56 driving a pinion gear 58. The pinion gear 58 meshes with a rack 60 mounted on a shaft 62 which is slidably supported in a generally U-shaped frame 64. As explained in detail hereinafter, the shaft 62 is connected to a cutter blade (not shown) so that movement of the shaft 62 trims the ends from the film. The motor 46 is then actuated to rotate shaft 50 through belt 52 to drive a pair of internal rollers (not shown) which remove the trimmed film chips from the cutting assembly 54.

A splicer assembly 68 positioned downstream of the cutter assembly 54 directs conventional heatseal tape to the film track 32 to cover the trailing edge of the previously loaded film and the leading edge of the subsequently loaded film, and then applies heat and pressure to the tape to secure the previously loaded film to the subsequently loaded film. The splicer assembly 68 includes an actuating lever 70 driven by a pneumatic actuator 72 having an internal piston connected to piston rod 74. The upper end of the actuating rod 70 is connected to a heated pressure shoe 116 which bonds the heatseal tape to the film F.

A second pair of drive rollers (not shown) positioned downstream of the splicer assembly 68 is selectively driven by a conventional stepping motor 76. An identification marking device 78 positioned just downstream of the motor 76 photographically applies an identifying number to the leading edge of the film. The processed film is then wound on a removable film magazine 80 having a center shaft 82 connected to a pulley 84 which is rotated through belt 86 by pulley 88. Tension on the belt 86 is maintained by idler roller 90. A conventional slip drive between the shaft 82 and a drive motor (not shown) allows the shaft to remain stationary while a rotational winding force is imposed on the shaft 82. The magazine 80 also includes an internal shutter (not shown) which automatically closes to shield the film contained therein when the magazine 80 is removed.

Figure 2:
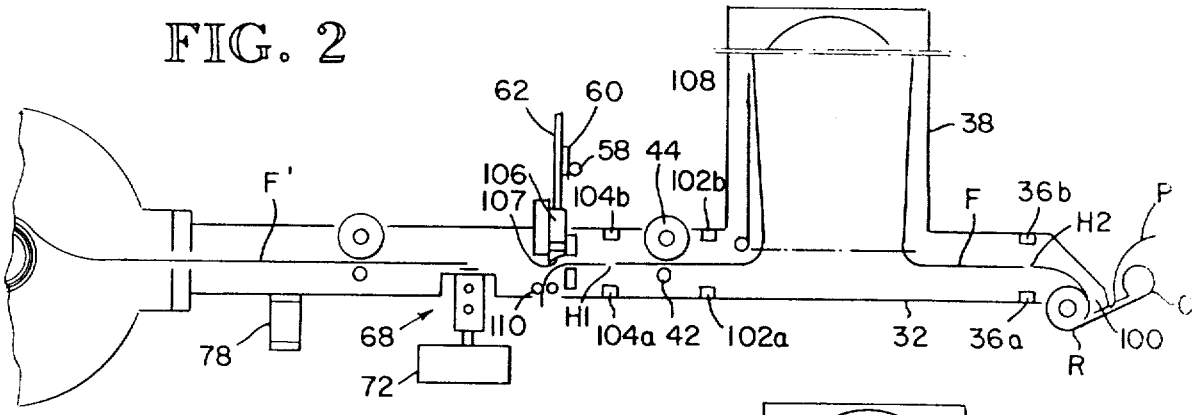
FIGS. 2–8 are schematics illustrating the operation of the film splicer.

The operation of the film splicer can best be explained with reference to FIGS. 2–8. The splicer is capable of operating in either a "film" mode or a "leader" mode. In the "film" mode a length of film is processed by the cutter assembly 54, splicer assembly 68 and identification marker 78 as described above. In the "leader" mode a length of conventional leader material is fed through the film guide 32 directly to the splicer assembly where it is secured to one end of the processed film. As illustrated in FIG. 2, in the film mode the film cartridge C is placed against an opening 100 in the end of the film track 32 by raising the handle 34 (FIG. 1). At that time the cartridge support 28 locks the cartridge C in place against the opening 100. The operator then pushes the violation plunger 30 to force the backing paper P from the cartridge C along the outside of the film guide 32. The operator then pulls the paper P from the cartrige C causing the film F to advance into the film track 32. The natural curve or set of the film F produced by winding it on a cylindrical reel R corresponds to the curvature of the forward end of the film track 32. Consequently, the film F advances along the film track 32. When the leading edge of the film F passes between infrared source 102*a* and infrared sensor 102*b* the friction rollers 42, 44 begin rotating to advance the film further along the film track 32. The film F contains a pair of position locating holes, one of which H1 is near the leading edge of the film and the other of which H2 is near the trailing edge of the film. The rollers 42, 44 continue to advance the film along the film track 32 with the leading edge of the film being guided downwardly between chip removal rollers 110 by the curved lower edge 107 of cutter blade 106. When the leading hole H1 passes between infrared source 104*a* and infrared sensor 104*b*, rotation of the friction rollers 42, 44 terminates. At this time the leading edge of the film F is beneath the cutting blade 106, but the cutting blade 106 is not actuated at this time. As additional film F is loaded into the film track 32 responsive to the operator pulling the backing paper P from the cartridge C the natural curve of the film F causes the film to contact a pivotally mounted door 108 and move it from the position illustrated in phantom in FIG. 2 to a vertical position. The additional film F loaded into the splicer is then received by the storage box 38 until the trailing edge hole H2 is positioned between infrared source 36*a* and infrared sensor 36*b*. The sensor 36 thus senses when all of the film F has been removed from the cartridge C and, as explained hereinafter, initiates the processing cycle.

The processing cycle could be initiated before all of the film F has been removed from the cartridge C such as, for example, when the leading edge hole is adjacent the sensor 104. However, with a relatively small percentage of cartridges, the film becomes stuck in the cartridge. With these relatively few cartridges the film is rewound onto the reel R and is subsequently removed with special handling. It is undesirable to begin processing the film and then remove the film from the splicer under these circumstances. Therefore, the splicer does not begin processing the film F until all of the film has been removed from the cartridge C.

Figure 3:
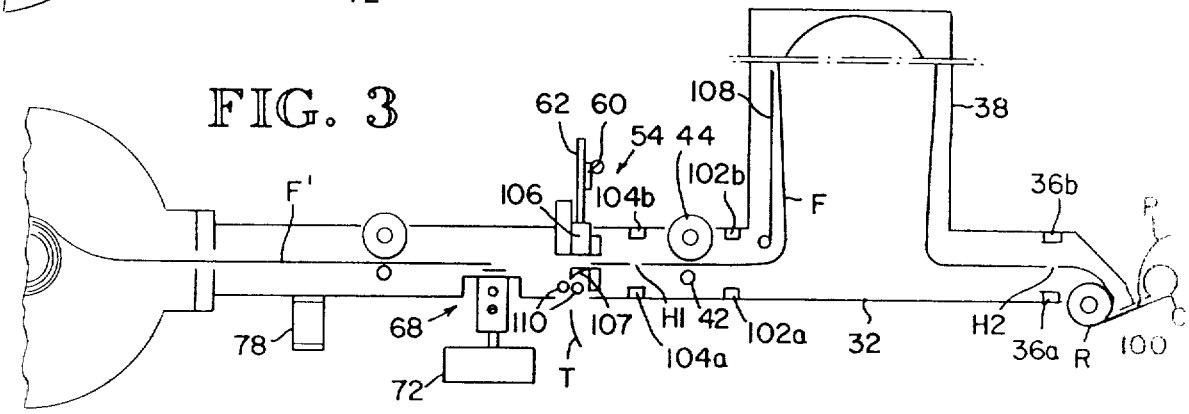

When the trailing edge hole H2 is adjacent the sensor 36 thereby indicating that all of the film F has been removed from the cartridge C the cutter blade 106 moves downwardly to the position illustrated in FIG. 3 thereby trimming the leading end of the film F. The forward end of the film F is then aligned with an aperture 112 in the blade 106.

Figure 4:
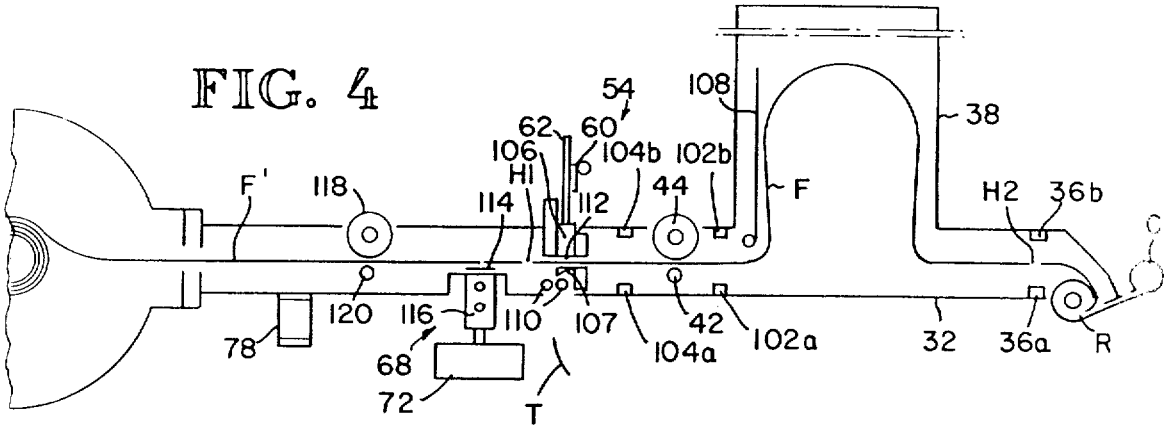

As illustrated in FIG. 4, the rollers 42, 44 are once again rotated to advance the film F toward the splicer 68. Rotation of the friction rollers 42, 44 also rotates the chip removal rollers 110 to discharge the chip T from the film guide 32. Since the position of the leading edge hole H1 is accurately located with respect to the leading edge of the film F, rotation of the rollers 42, 44 a preselected distance places the leading edge of the film F adjacent the trailing edge of the previously processed film F' at the splicer assembly 68. At the same time conventional heat seal tape 114 is fed to the sealer assembly 68 from a transverse position within the housing 14 (FIG. 1).

Figure 5:
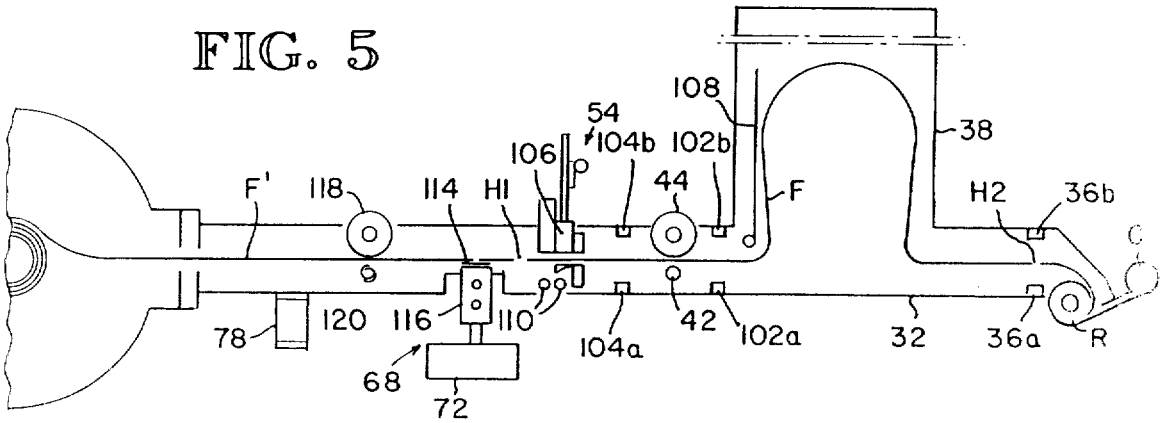

The pneumatic actuator 72 then raises the heated pressure shoe 116 against the heat seal tape 114 and film F, F' to securely bond the previously loaded film F' to the subsequently loaded film F as illustrated in FIG. 5.

Figure 6:
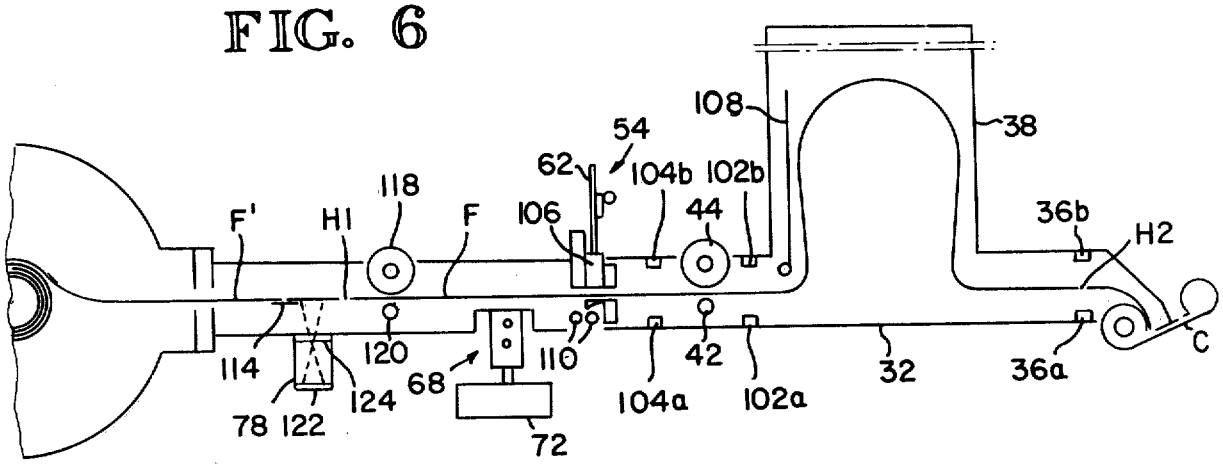

After the splicing operation the film is advanced by rotation of friction rollers 42, 44 and rollers 118, 120 which are rotated by motor 76 (FIG. 1) thereby drawing film F from the storage box 38 until the leading edge of the film F is above the film marking assembly 78. As illustrated in FIG. 6, the marking assembly 78 includes an array of light emitting diodes 122 which are focused onto the film F through a lens 124. The light emitting diodes 122 are selectively illuminated to produce sequentially varying numerals as explained hereinafter.

Figure 7:
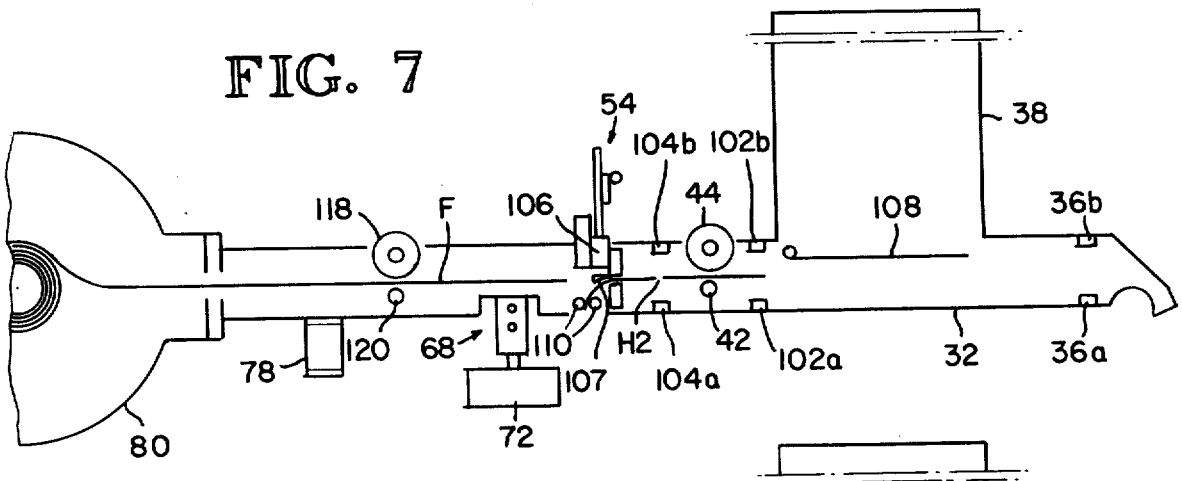
Figure 8:
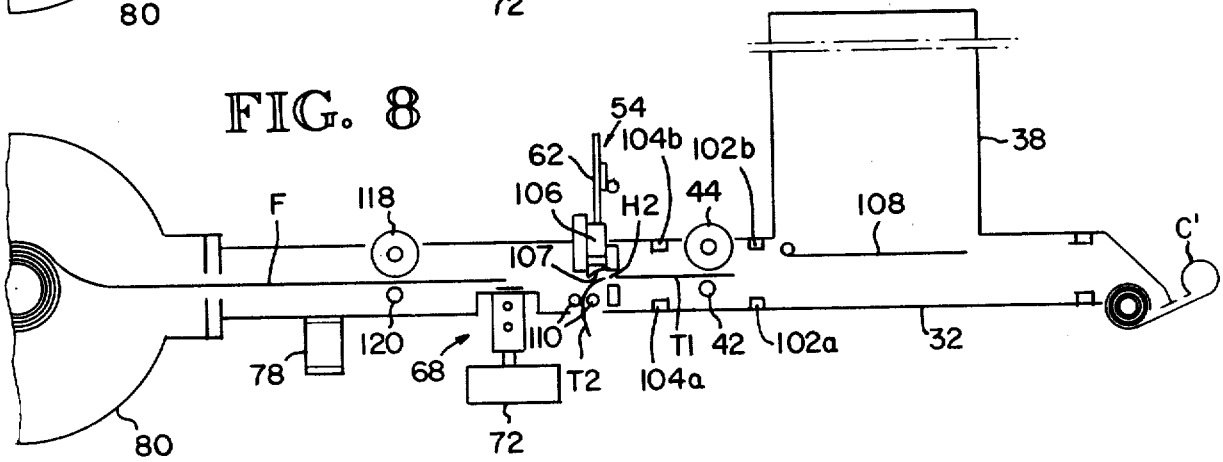

After the identifying number has been applied to the film F the rollers 42, 44, 118, 120 are driven to advance the film F a predetermined distance thereby allowing the pivotally mounted door 108 to drop to the position illustrated in FIG. 7. Movement of the film F terminates when the trailing edge hole H2 is adjacent the sensor 104, and the cutting blade 106 is then raised thereby trimming the trailing edge from the film which remains positioned between the rollers 42, 44. The solenoid for releasing the cartridge C from the film guide 32 is actuated as soon as the trailing edge has been trimmed from the film. Finally, the rollers 42, 44 are once again rotated so that the leading edge of the chip or trimmed portion T2 is guided downwardly by the curved surface 107 of the blade 106 between the rollers 110. As the rollers 42, 44 continue to rotate the chip removal rollers 110 discard the chip T2 from the film guide 32. The rollers 118, 120 continue to rotate until the trailing edge of the film is adjacent the splicing unit 68 as illustrated in FIG. 8. The sorter is then able to accept a new cartridge C'.

Figures 9, 10, 11, 12:
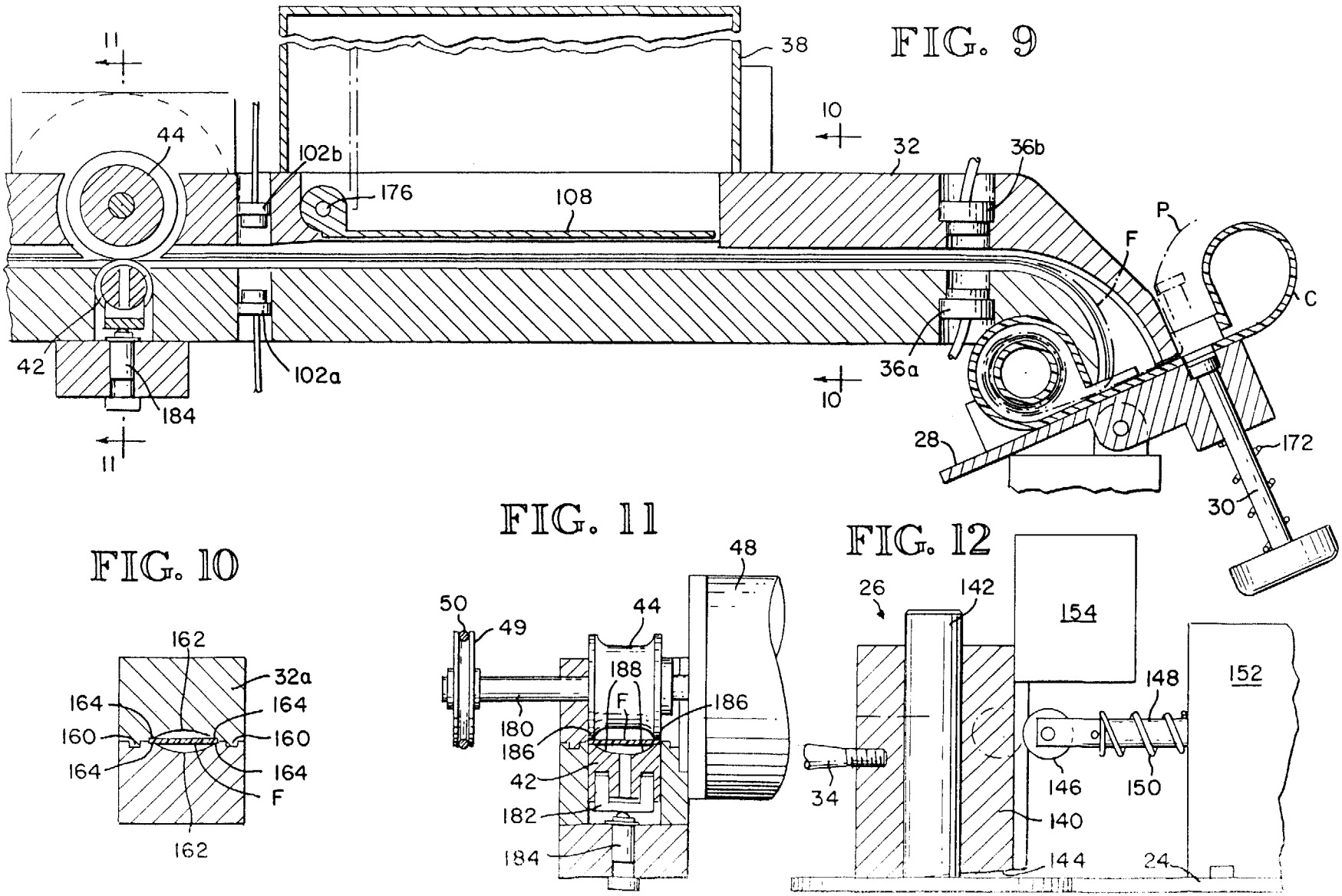
FIG. 9 is a cross-sectional view of the infeed end of the film guide.
FIG. 10 is a cross-sectional view taken along the line 10—10 of FIG. 9.
FIG. 11 is a cross-sectional view taken along the line 11—11 of FIG. 9.
FIG. 12 is a cross-sectional view of the remainder of the film guide.

The structural details of the film guide infeed portion are illustrated in FIGS. 9–11. As illustrated in FIG. 9, the loading assembly 26 includes a block 140 containing a cylindrical bore which slidably receives a cylindrical shaft 142 projecting upwardly from the base 24. The lower surface of the block 140 is beveled at 144. When the block 140 is raised by lifting the handle 34 a rotatably mounted roller 146 is positioned beneath the block 140 against the beveled surface 144 as illustrated in phantom. The roller 146 is mounted on an actuating lever 148 which is resiliently biased in its outward position by a compression spring 150. Consequently, the block 140 is locked in its upward position without being triggered by any externally actuated device. Thereafter, the block 140 may be lowered only by movement of the actuating lever 148 away from the block 140 by a conventional solenoid (not shown) enclosed by housing 152.

The film cartridge cradle 28 is pivotally secured to a mounting member 154 which is in turn secured to the block 140. Accordingly, when the cartridge C is positioned on the cradle 28 and the handle 34 is raised, the cartridge C remains resiliently biased against the downwardly facing end of the film guide 32. After the trailing edge has been trimmed from the film F the solenoid contained in the housing 152 is actuated allowing downward movement of the block 140 to permit removal of the cartridge C from the support 28.

As the operator draws the backing paper P from the cartridge C the film is fed into the film guide 32 as explained above. As best illustrated in FIG. 10, the film guide 32 is composed of an upper section 32*a* and a lower section 32*b*. Relative lateral movement between the sections 32*a*,*b* is prevented by interlocking flanges 160. The opposed surfaces of the upper and lower sections 32*a*,*b* contain longitudinal groove each having a curved center portion 162 extending between flat end portions 164. The flat portions 164 loosely contact the edges of the film in the sprocketed area, and the central portions 162 provide clearance between the film guide 32 and the image containing portion of the film F. Thus the film guide 32 securely guides the film F along the film path without contacting and potentially damaging the image containing surface of the film.

After the cartridge C is positioned against the downwardly projecting end of the film guide 32 and locked in place the violation plunger 30 which is slidably received in the cartridge support 28 is depressed by the operator to remove the end of the backing paper P from the right hand portion of the cartridge C so that it may be grasped by the operator. A compression spring 172 coiled around the shaft of the plunger 30 then returns the plunger 30 to its original position. As best illustrated in FIG. 9, the access door 108 to the storage box 38 is mounted on a shaft 176 which is rotatably mounted in the upper portion of the film guide 32*a*.

As the film F moves downstream it passes between an infrared source 102*a* and infrared sensor 102*b* before contacting the rollers 42, 44. As best illustrated in FIG. 11, the upper roller 44 is fixedly mounted on the shaft 180 of the stepping motor 46 which terminates in the pulley 48 for rotating the chip removal rollers 110 (FIGS. 2–8) through belt 50. The lower rollers 42 are rotatably mounted on a generally U-shaped support 182 which is resiliently biased toward the upper roller 44 by a spring loaded detent member 184. The rollers 42 contain a flat portion 186 contacting the film F and a downwardly curved portion 188 providing clearance between the rollers 42 and the film F.

The next downstream portion of the film guide 32 as illustrated in FIG. 12 includes the infrared source 104*a* and sensor 104*b* and the cutter assembly 54. The cutter blade 106 is positioned between a shear block 200 having an upper section 200*a* and a lower section 200*b*. A wear block 202 of a resilient material such as acetal sold under the trademark DELRIN contacts the opposite side of the blade 106 to resiliently bias it against the shear block 200. The structure of the cutter blade 106 and shear block 200 are further illustrated in FIGS. 13–15. A vertical slot 130 formed in the cutter blade 106 receives the actuating shaft 62 and is secured thereto by recessed screws 132 extending through the blade 106 into the shaft 62. The lower end of the shaft 62 terminates just about the transverse aperture 112 through which the film passes when the blade 106 is in its downward position. The curved lower surface 107 is formed in the blade 106 in the central portion and downwardly depending legs 134 provide some transverse guidance to the film. The mating surfaces of the shear blocks 200*a,b* are beveled inwardly from the transverse edge toward the center. Consequently, the shear forces imparted to the film act on a single point at any one time. During the cut the shear points progress inwardly toward the center from the sides of the cutter blade 106 and shear block 200. The point shear cutting action allows the film to be cut with a relatively low cutting force. The shear blocks 200*a,b* are rigidly mounted in the film guide 32*a,b*, respectively, by shafts 136 extending through the shear blocks 200 into the film guide 32.

The structural characteristics of the cutting assembly 54 which guide the leading edge of the film F into the chip removal rollers 110 is best illustrated in FIGS. 14, 15. When the blade 106 is in its upper position the curved lower surface 107 of the blade 106 flushly meets the lower surface of the upper shear block 200*a* while the downwardly depending legs 134 enclose the entire slot between the upper and lower shear blocks 200*a,b*, respectively. When the blade is in its lower position as illustrated in FIG. 15 the upwardly sloping surfaces of the aperture 112 guide the film F upwardly between the upper and lower film guides 32*a,b*, respectively, in order to prevent the leading edge of the film from catching on the surface of the lower guide 32*b* which abuts the blade 106.

The splicer assembly 68 which is located slightly downstream of the cutter assembly 54 is best illustrated with reference also to FIG. 16. The actuating lever 70 which is connected to the pneumatic actuator 72 is secured to the heated pressure shoe 116 by a shaft 142 extending through the block 116 and lever 70. The pressure shoe 116 is forced against a guide plate 146 (FIG. 16) by a pair of rollers 148 rotatably mounted on a support frame 150. A roll of the conventional heatseal tape 114 stored in a daylight environment is selectively advanced toward the splicer assembly 68 by a pair of friction roller 154, 155 which are rotated by a conventional stepper motor 156 (FIG. 1). The end of the heatseal tape 114 is guided into the film path by guide plate 157 which is bolted to a guide frame 158. In operation the end of the heatseal tape 114 is advanced into the film path and the pressure shoe 116 is raised thereby forcing the heatseal tape 152 against the film F which in turn contacts pressure plate 160 to securely bond the two section of film F,F' to each other. At the same time the upward movement of the pressure shoe 116 shears the tape 114 between the pressure block guide plate 146 and heatseal tape guide plate 157. After a predetermined period the pressure shoe 116 is lowered to the position illustrated in FIG. 16 thereby completing the splicing procedure. The presence or absence of heatseal tape is detected by optical sensor 162, which sounds an alarm and displays the situation on the display 22. The splicer is then permitted to perform a specific number of additional splices before operation of the splicer terminates. An appropriate key on the keyboard 18 is then actuated and the motor 156 withdraws the tape remnant from the splicer. A new roll of tape 114 is then advanced to the rollers 154, 155, and a key on the keyboard 18 is actuated to advance the tape 114 past the sensor 164 to the film guide 32. A second sensor 164 detects the leading edge of the tape 114 when a new supply of tape 114 is loaded into the splicer in order to initialize the circuitry controlling the stepper motor 156 which drives pressure rollers 154, 155.

Figure 13:
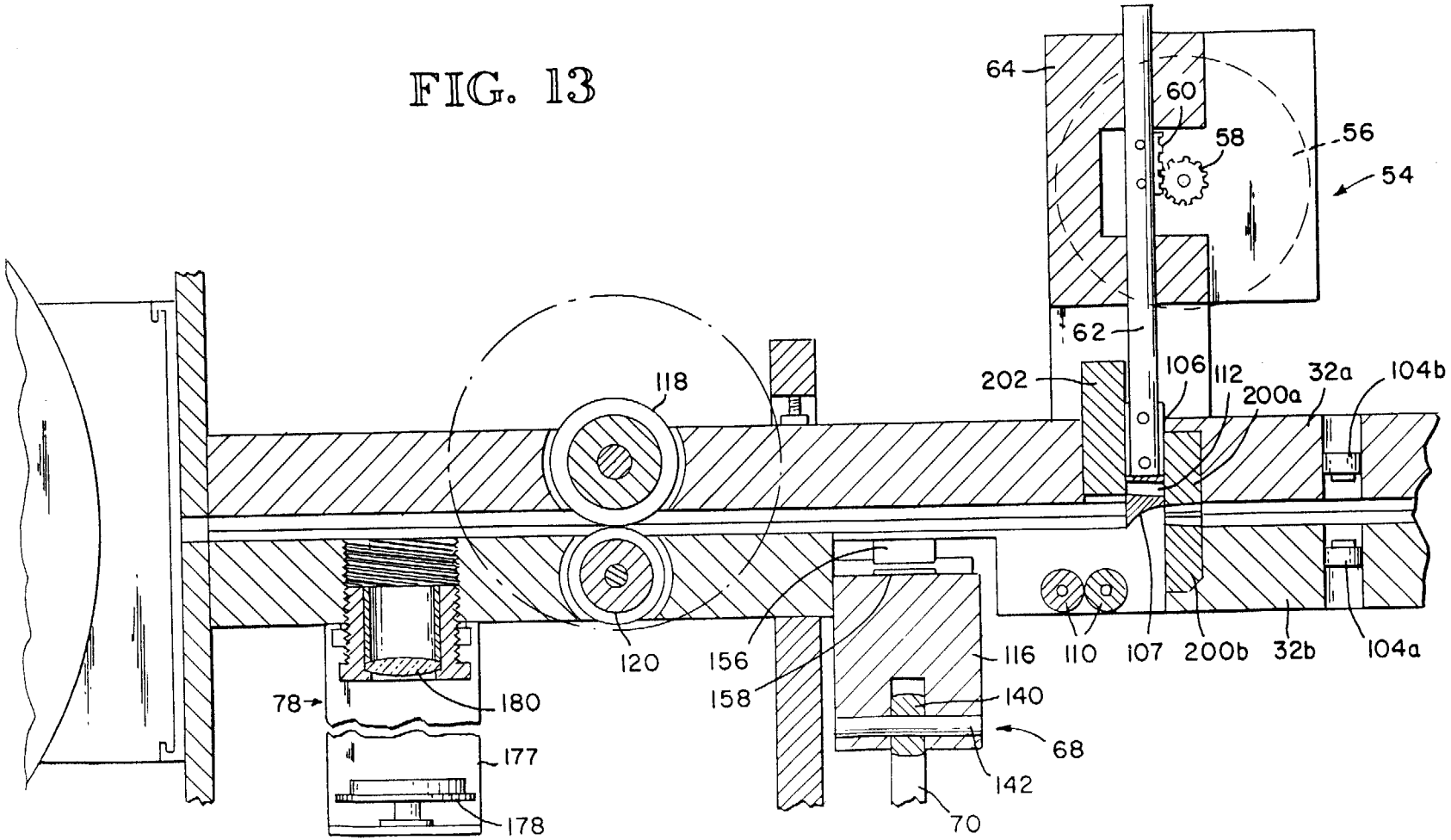
FIG. 13 is an exploded iosmetric view of a portion of the cutter assembly.

The identification marker 78 as illustrated in FIG. 13 includes a housing 177 enclosing a conventional array of light emitting diodes 178 which is focused onto the film F by a lens 180. The light emitting diodes in the array 178 are selectively illuminated to generate numerical markings which are photographically recorded on the film F.

Figure 17:
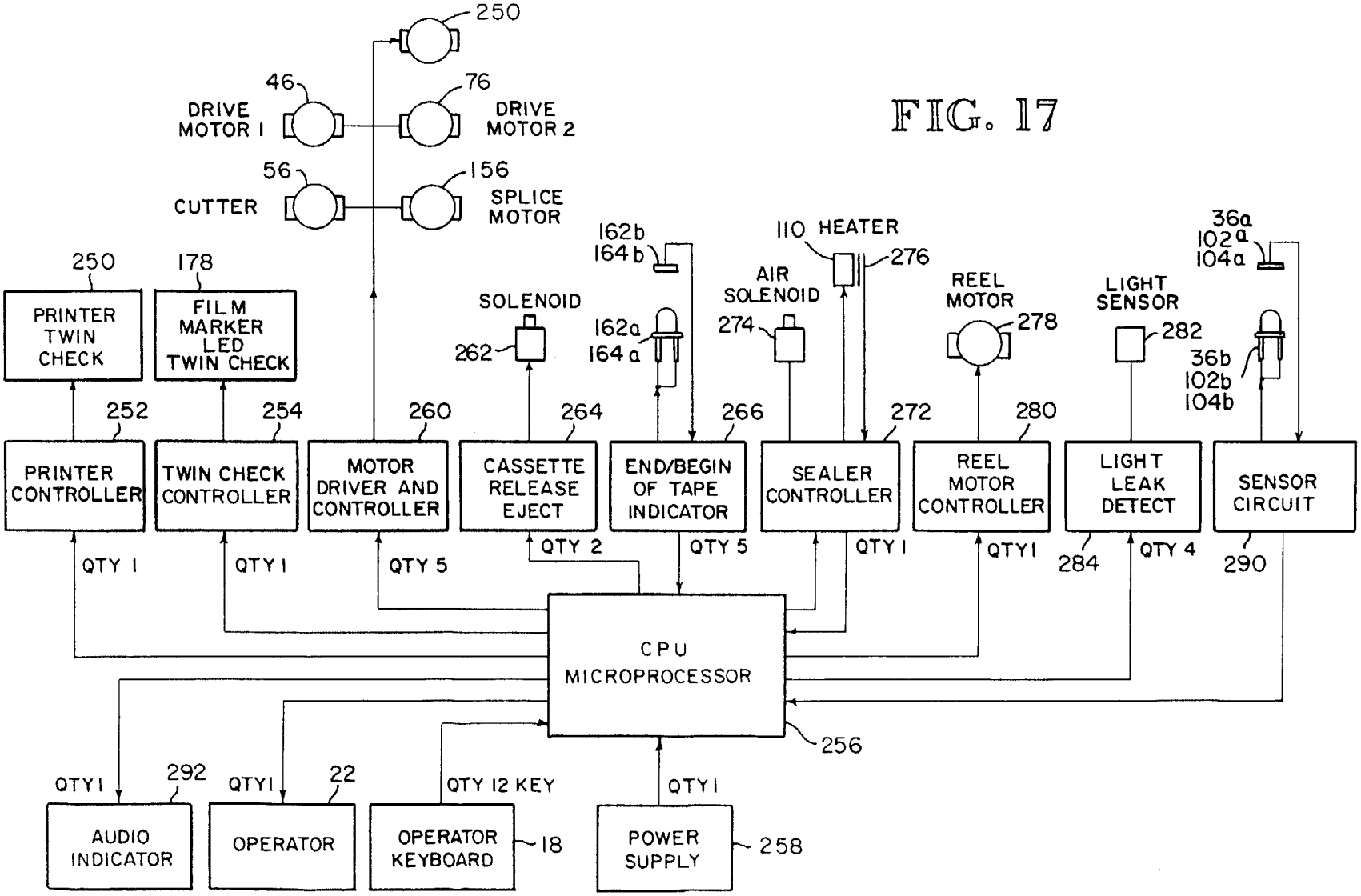
FIG. 17 is a block diagram of the splicer electronics.

An electronic block diagram of the splicer system is illustrated in FIG. 17. The system includes a conventional printer 250 which is operated by a printer controller 252 to print a number on a film return envelope which is identical to the number displayed by the array of light emitting diodes 178 which are selectively illuminated by a controller 254. Both of the controllers 252, 254 are simultaneously triggered by a central processing unit 256 which is preferably a conventional microprocesser powered by a conventional power supply 258. The previously described drive motors 46, 76, the cutter motor 56 and the splice tape motor 156 as well as an internal motor 258 in the printer 250 are each controlled by a motor driver and controller circuit 260 described in detail hereinafter. The actuating arm 148 (FIG. 9) utilized to release the cassette C from the downwardly directed end of the film guide 32 is actuated by a conventional solenoid 262 which is in turn controlled by a release circuit 264 upon being triggered by the microprocessor 256. In order to prevent operation of the splicer when the supply of splicing tape 114 (FIG. 16) has become exhausted and to detect the end of the splicing tape when the tape 114 is initially loaded into the splicer, the sensor light sources 162*a*, 164*a* which are powered by circuit 266 are positioned at one side of the splicing tape 114, and the light sensors 162*b*, 164*b* are positioned on the opposite side of the splicer tape 114. When the supply of splicing tape 114 has become exhausted light from the lamp 162a is received by the sensor 162b to signal the indicator circuit 266 which in turn informs the microprocessor 256 to suspend operation. When tape 114 is reloaded into the splicer light source 164a and sensor 164b work in a similar manner to initialize the tape motor drive control.

The operation of the sealer assembly 268 is controlled by a sealer control circuit 272 which selectively actuates a solenoid 274 for directing air to and from the pneumatic actuator 72 which raises and lowers the pressure show 116 against the film. The circuit 272 also powers the heater in the pressure shoe 116 (FIG. 16), and receives the output of a conventional thermistor mounted in the shoe 116. The sealer controller circuit 272 thus measures the temperature of the pressure shoe 116 and adjusts the power supplied thereto to provide a preset temperature as measured by the thermistor 276. As explained above the spliced film is wound on the axle 82 (FIG. 1) of the film magazine 80. The axle 82 is rotated by a reel motor 278 which may be a conventional A/C motor powered by a reel motor controller circuit 280. Since the purpose of the reel motor 278 is simply to impart a torque to the axle 82 rather than to rotate the axle 82 a predetermined distance the operation of the reel motor 278 is not critical. The system also includes a conventional light sensor 282 for providing a signal to a light leak detector circuit 284 indicative of light entering either of the enclosures 12, 14. Thus, operation of the splicer is terminated in the event that either of the covers 12, 14 are removed. The infrared light sources 36a, 102a, 104a are powered by a sensor circuit 290 which receives the outputs of respective infrared sensors 36b, 102b, 104b. The central processing unit also receives information from the keyboard 18, and provides outputs to the conventional display 22 and a conventional audio signal device 292.

Figure 18A:
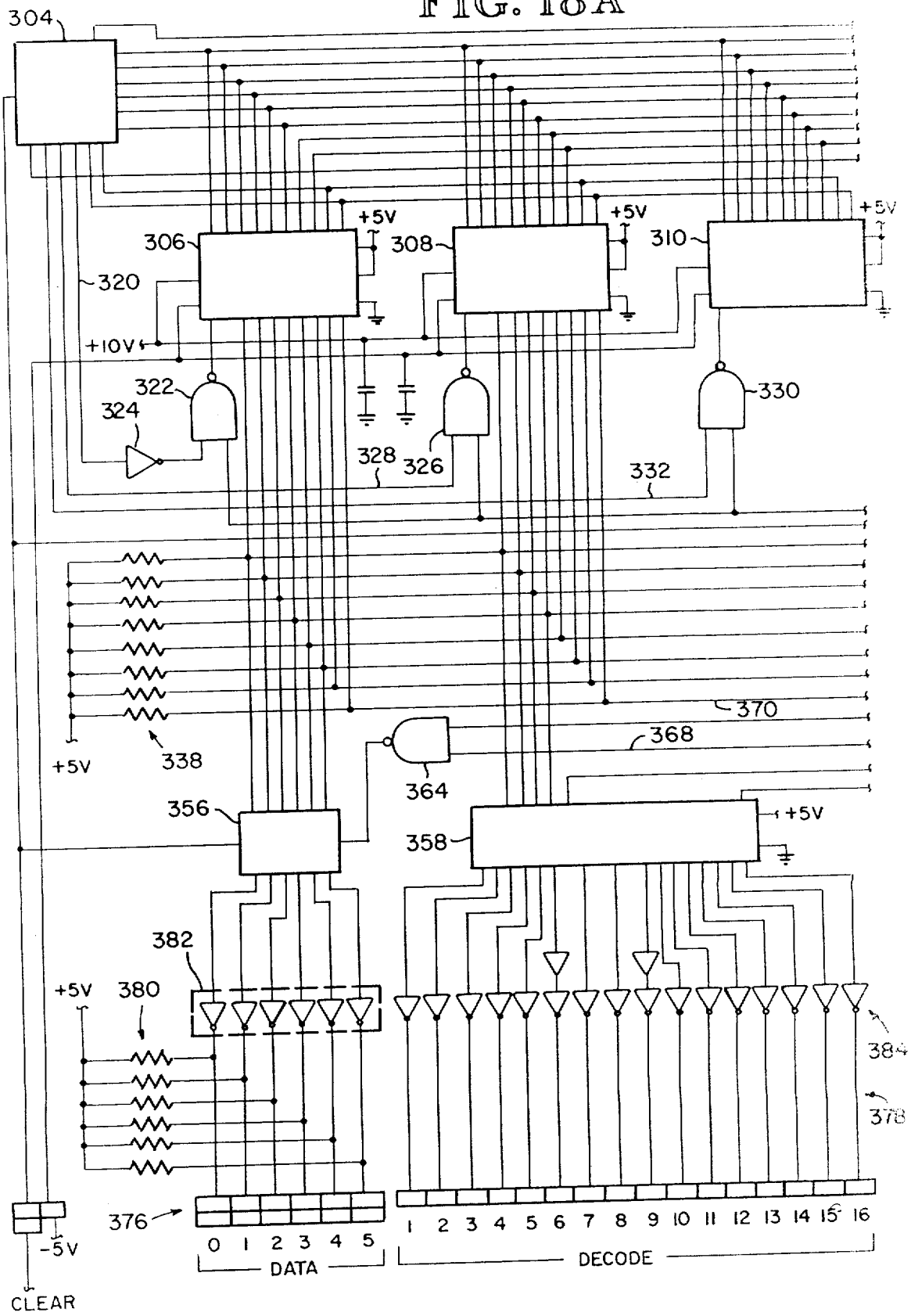
FIGS. 18A and 18B taken together form a schematic of the central processing unit of the splicer.
Figure 18B:
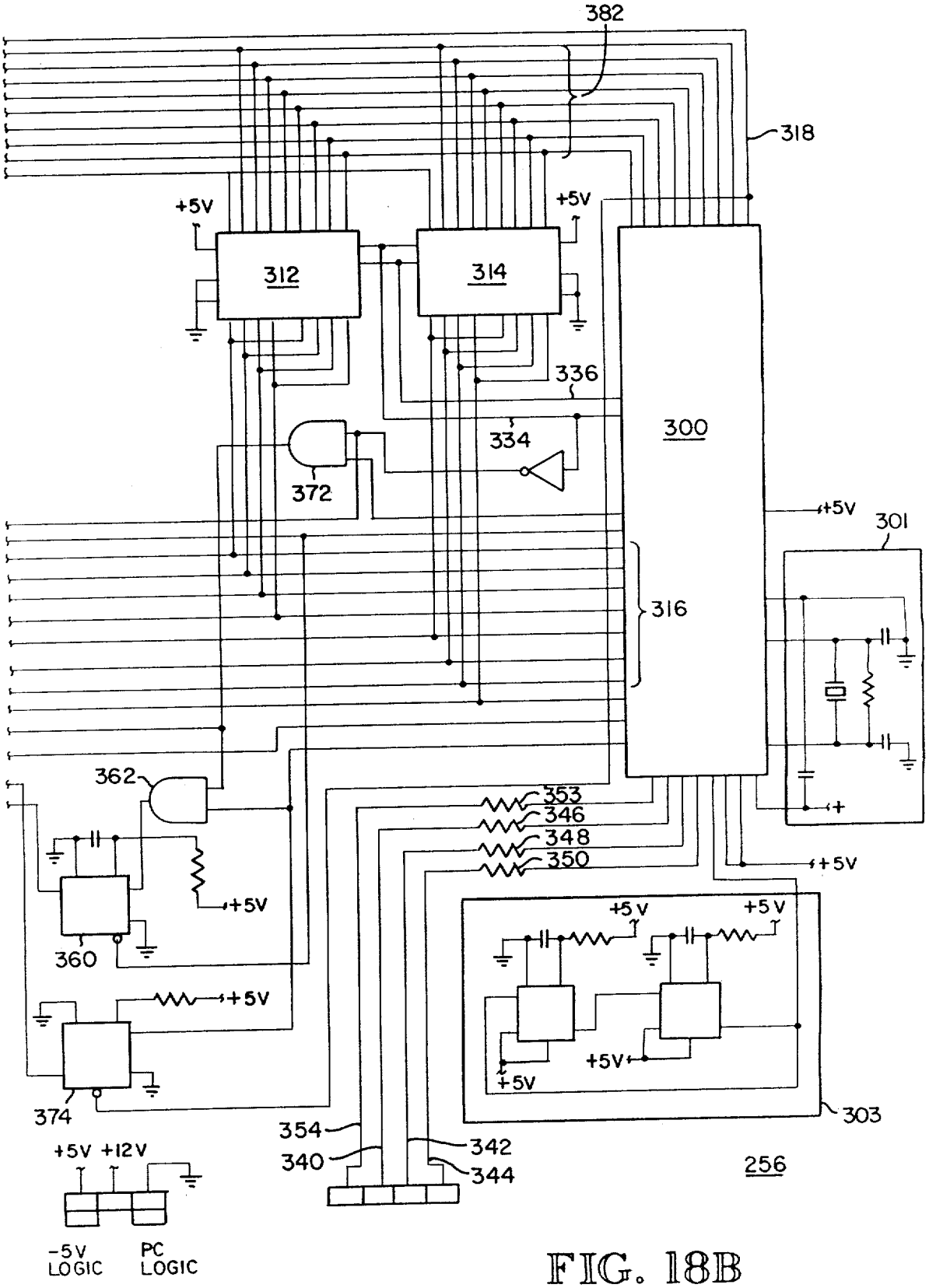

The central processing unit 256 as illustrated in FIG. 18 utilizes a conventional microprocessor 300 driven by a first oscillator 301 acting as a clock for the microprocessor 300 and a second oscillator 303 periodically interrupting the microprocessor 300 to update the display 22 (FIG. 1). The microprocessor has an 8-bit address bus 302 connected to an address latch 304, read only memories 306, 308, 310 and random access memories 312, 314. The central processing unit also includes an 8-bit data bus 316 which is connected to all of the memories 306–314. The program instructions and various tables are stored in the read only memories 306–310 while the random access memories 312, 314 are used during execution of the program. The data appearing on the data bus 316 is selected from one of the memories 306–314 by identification of the proper address since each memory has an exclusive set of addresses. Although the address bus from the microprocessor 300 contains only 8 bits, a 14-bit address word is generated by the CPU 300 and the address latch 304. Bits 8–13 are generated at the output of latch 304 from corresponding address bits 0–6 during the first part of the addressing cycle responsive to a latch signal produced by the microprocessor 300 on line 318. During the next portion of the addressing cycle address bits 0–7 are generated by the microprocessor 300. All 14 of these address bits are received by the memories 306–314, but the higher order address bits select which of the memories are to provide data to or receive data from the data bus 316. When the 14-bit address line 320 goes low, NAND gate 322 is enabled through inverter 324 to select read only memory 306. Similarly, NAND gate 326 is enabled when bit 11 of the address 328 goes high to select read only memory 308, and NAND gate 330 is enabled through line 332 when the twelfth address bit goes high to select memory 310.

The random access memories 312, 314 are 4-bit memories. Consequently, the first four data bits are connected to memory 312 while the high order data bits are connected to memory 314. The read only memories 306–310 are selected as a group when the eighth and ninth address bit lines from the latch 304 are high. Similarly, the random access memories 312, 314 are selected when the thirteenth address bit from latch 304 goes high. The memories 306–314 provide outputs to the data bus when the memory read line 334 is actuated thereby producing output from one of the NAND gates 322, 326, 330 selected by the address latch 304. Similarly, the random access memories 312, 314 output data to the data bus 316 when the memory write line 336 goes high. The data bus 316 is normally held at plus 5 volts through pull-up resistors 338, but the data bus is selectively grounded by the memories 306–314 or the microprocessor 300.

The microprocessor 300 also receives inputs on lines 340, 342, 344 through resistors 346, 348, 350. The microprocessor 300 is reset through resistors 352 upon receipt of a reset signal on line 354.

Data from the central processing unit 256 is transmitted to other portions of the electronic system as selected by a pair of output latches 356, 358. Basically, the latch 356 contains the data which is to be transmitted to another portion of the circuit while the information contained in latch 358 designates the electronic circuit which is to receive the data. During the first portion of the output cycle the recipient of the data is selected by placing appropriate signals on the low order data bits and inputing this data to the latch 358 by actuating a one-shot 360 from NAND gate 362. During the second portion of the output cycle, six low order bits of data are read into latch 356 by a trigger signal from the output of NAND gate 364. Both of the NAND gates 362, 364 are enabled by respective enabling signals on lines 366, 368 and are triggered through line 370 by the output of NAND gate 372 when the memory read signal is present on line 334. The memory read signal on line 334 is basically an indication that the signals present on the data bus are valid data signals. In the final portion of the data cycle a second one-shot 374 is triggered and the data appearing on output data lines 376 control one of the electronic circuits as determined by a pulse appearing on one of the device select lines 378. The width of the device select pulse is determined by the width of the pulse from the one-shot 374. Output data lines 376 are normally held high by pull-up resistors 380 but are selectively grounded by driver circuit 382. Output lines 378 are connected directly to the outputs of inverters 384. In summary, the central processing unit 256 receives inputs from lines 340–344 and generates output on lines 376 to specific devices determined by lines 378 in accordance with predetermined program instructions or tables contained in memories 306–310.

Figure 19:
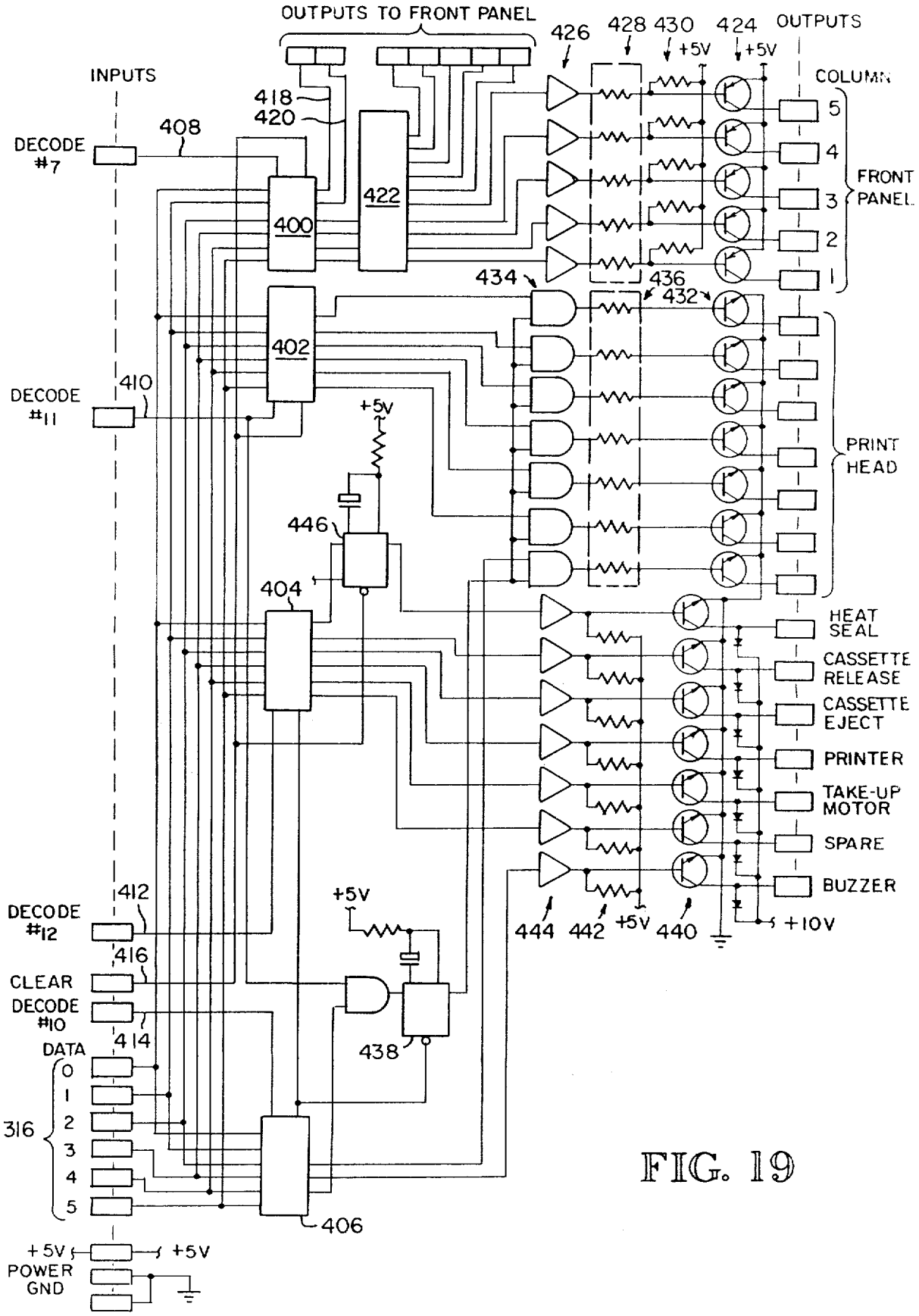
FIG. 19 is a schematic of one control circuit of the splicer.

As illustrated in FIG. 19, the data output lines 316 are connected to several latches 400–406 which input data on the lines responsive to respective control signals on lines 408–414. The data in the latches 400–406 are erased by a signal on the clear line 416 when power is applied to the splicer. Latch 400 is utilized to control the operation of the front panel display 22 (FIG. 1) and keyboard 18. The display is a conventional LED array sold by Hewlett-Packard. Basically, the array is divided into two sections one of which receives data serially on line 418 and the other of which receives data serially on line 420. The light emitting diode sections each display four digits with each digit having an array of light emitting diodes arranged in five vertical columns and seven horizontal rows. Each section includes five internal shift registers (one for each column) into which the data is serially entered. In operation the first column for all four digits is selected and data is read into the shift register for the first column, and the register selectively illuminates the light emitting diodes in all of the first columns. The second column is then selected and the data is read into the second column shift register and the appropriate diodes in the second column of each of the digits are then illuminated. Four of the outputs of latch 400 are applied to a 1 to 10 decoder 422 which selects a single column at any one time to which data is read. The outputs of the decoder 422 are applied to the bases of transistors 424 through drivers 426 and resistors 428 to selectively power each of the columns. The transistors 422 are normally biased in an off condition by resistors 430. Summarizing the operation of the displays, data from the data output lines 316 is held at the output of latch 400 by a signal on line 408. The latch output 400 comprises serially presented data on lines 418 and 420 which is read into the column of each digit selected by one of the transistors 424. Since each display has four digits, and each digit has seven light emitting diodes in each column, each of the column transistors 424 is saturated for 28 bits of data on lines 418, 420 before the data is read into the next column.

Figure 20:
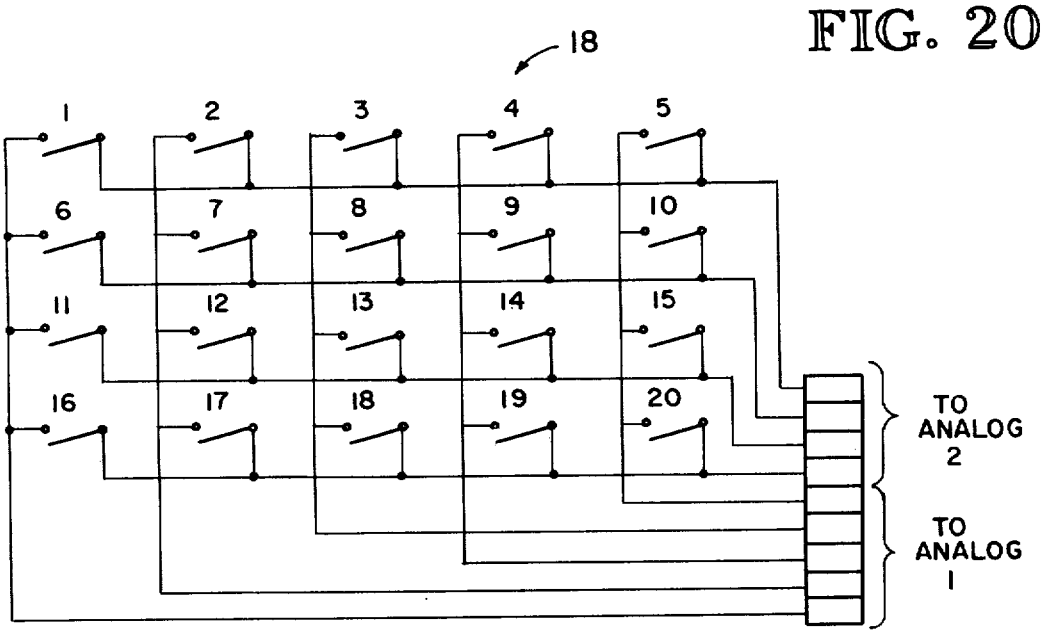
FIG. 20 is a schematic of the keyboard for controlling the operation of the splicer and providing data to the splicer.

The upper five outputs of the decoder 422 are connected to the keyboard as illustrated in FIG. 20. The keyboard 18 is basically a plurality of switches arranged in five vertical columns and four horizontal columns. Only one output of decoder 422 is high at any one time so that each of the vertical columns of the keyboard 18 are sequentially powered. At the same time the horizontal rows of the keyboard are monitored and applied to circuit illustrated in FIG. 21 in order to determine which key is being depressed. In summary, vertical column 1 is powered and all of the horizontal rows are monitored to determine which if any switch in column 1 is depressed. Column 2 is then powered and all of the switches in the horizontal rows are monitored to determine which if any of the switches in column 2 are closed. Each of the columns are then sequentially examined in the same manner.

Latch 402 is utilized to control the print head on the printer 250 (FIG. 17) which prints an identifying number on an envelope corresponding to the number photographically placed on the film. The print head consists of a number of solenoids each of which drive one of seven vertically arranged dots so that as the print head sweeps across the paper characters are printed by selectively energizing the solenoids. The solenoids are driven by transistors 432 which are normally at cutoff but which saturate to draw current through the solenoids responsive to a high output from AND gates 434 through resistors 436. The AND gates are enabled by the outputs of latch 402 but are triggered by the output of one-shot 438 which is in turn triggered by the control signal to latch 402. One-shot 438 is provided to insure that the width of the pulse to the print head solenoids is sufficient to generate the proper printing force while insuring that the width does not exceed a value which would damage the solenoids. The outputs of latch 404 selectively saturate transistors 440 in much the same manner as transistors 424 are saturated. The transistors 440 are normally saturated through resistors 442 but are selectively driven to cutoff by drivers 444. The output transistors 440 are connected to the various assemblies of the splicer such as the pneumatic actuator solenoid 274 (FIG. 17) for the splicer, the film cassette release solenoid 262, the printer carriage motor 258, the film magazine take-up motor 278 and the audio indicator 292. The transistor 440 for controlling the solenoid 274 for the pneumatic actuator is triggered by latch 404 through one-shot 446 in order to allow the central processing unit to perform other functions during the relatively lengthy splicing procedure.

Figure 21:
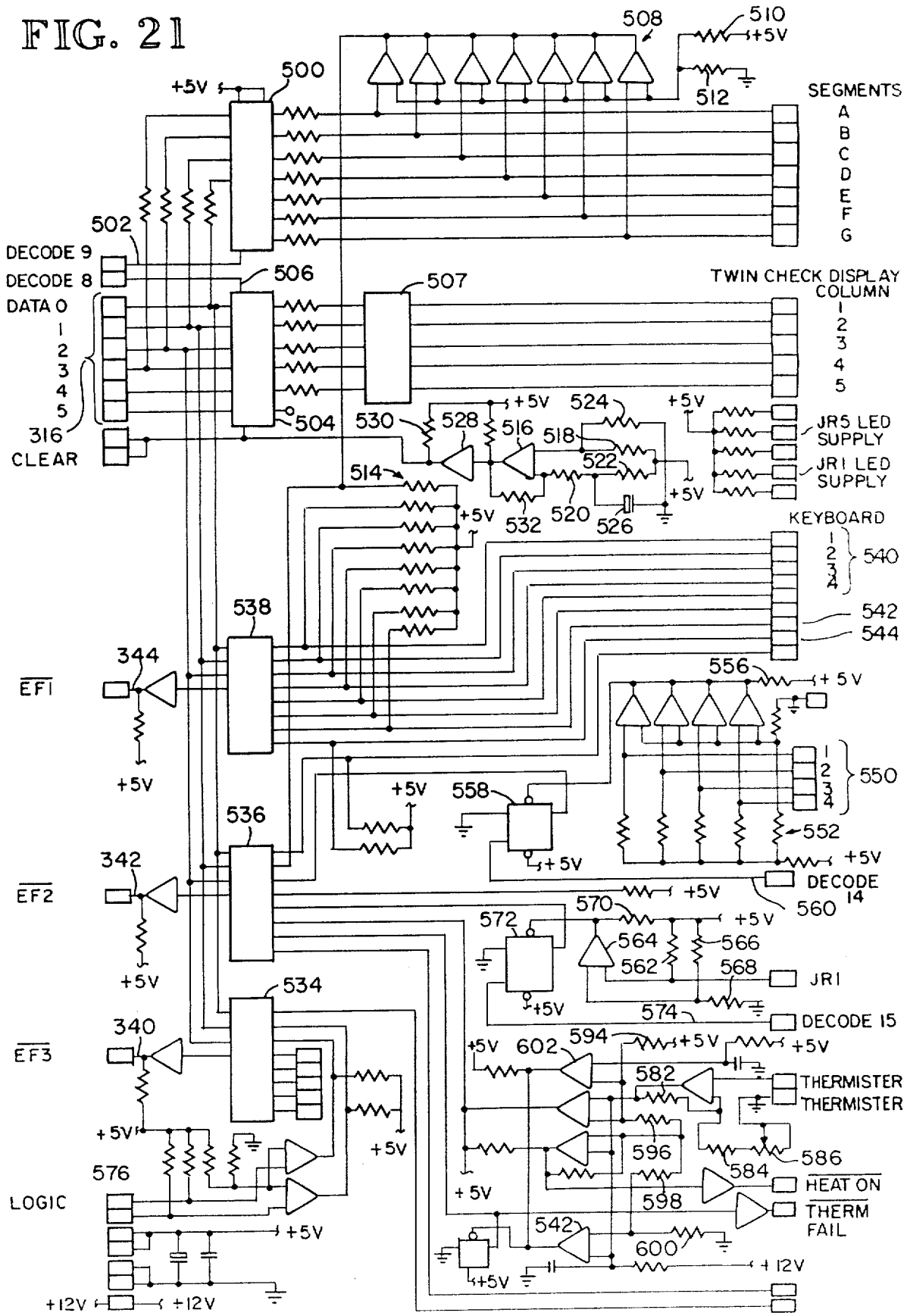
FIG. 21 is a schematic of additional control circuitry for the splicer.

The circuitry for controlling the illumination of the diodes in the light emitting diode array 178 for the film identification marker 176 (FIG. 12) is illustrated in FIG. 21. The array of light emitting diodes includes five seven-segment arrays. The segments for each column are determined by the outputs of decoder-latch 500 which record data from the data output lines 316 responsive to a latch signal on line 502 from the central processing unit 256. The column or digit to be illuminated is determined by data recorded in latch 504 responsive to a latch signal on line 506. The outputs of latch 504 are connected to the light emitting diode array through driver circuit 507. In operation, the segments to be illuminated for the first digit are read into the decoder latch 500 from the data output lines 316. The column 1 output from the driver 506 is then energized by reading the data on lines 316 into latch 504 to illuminate the light emitting diode segments of the first digit which have been selected by the decoder-latch 500. The next digit is then illuminated by recording data from the data output lines 316 into the decoder latch 500 and then powering the second column or digit from latch 504. In this manner each of the digits are sequentially illuminated. In order to insure that the identification marking system is working properly, the current through the diodes are monitored by comparitors 508. The positive inputs to the comparators receive a reference voltage of approximately 2½ volts from the junction of resistors 510, 512. The negative terminal of each of the comparators 508 is connected to the anode of one of the light emitting diodes. If the respective light emitting diode connected to the negative terminal is not selected for illumination by the decoder-latch 500 the voltage on the negative terminal is zero thereby producing a positive comparison which leaves the output of the comparator 508 floating. If the light emitting diode segment connected to the comparitor 508 is selected by the decoder-latch 500 to be illuminated the voltage across the diode is about 0.6 volts which also produces a positive comparison at the comparitors 508. However, if the diode selected for illumination from the decoder-latch 500 is open the voltage at the negative input to the respective comparator 508 is negative thereby grounding the output of the comparitor 508 which is normally held high by pull-up resistor 514. In summary, if any of the diodes in the light emitting diode array have opened an indicating signal is produced at the outputs of the comparitors 508.

In order to properly initialize this system when power is initially applied to the splicer, a power up initializing circuit is provided to reset the latches and the central processing unit. The power supply voltage is connected to a comparator 516 through resistors 518, 520, 522. The negative terminal of the comparator 516 is connected to ground through resistor 524, and the junction between resistors 520 and 522 is connected to ground through capacitor 526. When power is initially applied to this system the capacitor 526 grounds the positive terminal of the comparator 516 to produce a negative comparison which produces a low clear signal at the output of driver 528 which is normally held high by pull-up resistor 550. The gain of comparator 516 is limited by feed-back resistor 532. The clear signal resets the decoder latch 500 and the latch 504 as well as latches shown in FIGS. 18 and 19.

The input 340, 342, 344 to the microprocessor 300 (FIG. 18) is selected by respective multiplexers 534, 536, 538 in accordance with control signals received on the data output lines 316. Basically, the multiplexers 534–538 select one of many possible inputs to the microprocessor 300. These possible inputs include the keyboard column outputs 540 from the keyboard as illustrated in FIG. 20, input 542 from a switch in the printer indicating the absence of an envelope in the printer and a pair of inputs 544, 546 connected to left and right carriage switches for indicating the position of the printer head. One of these several aforementioned inputs is selected by the multiplexer 538 to appear on input line 344.

As mentioned above, the splicer includes light sensors positioned in the housings 12, 14 (FIG. 1) to detect the presence of light within the splicer. These sensors are powered through lines 550 and resistors 552, and the voltage across each sensor is applied to the positive input of comparators 554. The negative inputs to comparators 554 receive a reference voltage. The voltage across the sensors is normally of sufficient magnitude to produce a positive comparison at the comparators 554 allowing the pull-up resistor 556 to maintain their outputs high. However, when light reaches one of the sensors its resistance decreases causing the voltage thereacross to be reduced sufficiently to produce a negative comparison which sets flip-flop 558. The Q output of flip-flop 558 is connected to multiplexer 536 which is periodically sampled to determine if light is entering the splicer. The flip-flop 558 may then be reset by a reset signal from the central processing unit on line 560.

As mentioned above, an optical sensor 162 is positioned adjacent the tape supply 114 (FIG. 16) for indicating that the tape supply has been exhausted. The sensor is powered through a resistor 562, and the voltage across the sensor which may be a conventional photocell is applied to the positive terminal of comparator 564. A reference voltage produced between resistors 566 and 568 is applied to the negative terminal of comparator 564. When a tape supply is present the comparison at the comparator 564 is positive allowing pull-up resistor 570 to place the output of comparator 564 high. However, as the tape supply becomes exhausted a light source strikes the sensor reducing the voltage on the positive terminal of comparator 564 thereby grounding the output of comparator 564 and setting flip-flop 572. The Q output of flip-flop 572 is applied to multiplexer 536 which periodically samples the flip-flop 572 to inform the central processing unit 256 that the supply of tape is exhausted through input line 342. The flip-flop 572 may then be subsequently reset through reset line 574. An identical sensor circuit 576 monitors the optical sensor 164 to determine the position of the end of the splicer tape.

The temperature of the heated pressure shoe 116 is measured by a thermistor as described above. The voltage across the thermistor is applied to operational amplifier 580 which has its gain controlled by feedback resistor 582, fixed resistor 584 and variable resistor 586. By adjusting the gain of the amplifier 580 the voltage at the output of the amplifier 580 for a given temperature is adjusted. Thus, as explained hereinafter, the variable resistor 586 determines the temperature set point. The output of amplifier 580 is applied to the positive input of a first comparator 588, the negative input of a second comparator 590 and the positive input of a third comparator 592. Reference voltages of sequentially decreasing magnitude are applied to the other inputs of comparators 588–592 from voltage dividers formed by resistors 594, 596, 598 and 600. The voltage across the thermistor directly applied to the negative input of comparator 602 having a positive input which receives the same reference voltage as the comparator 588. The voltage across the thermistor is inversely proportional to temperature, and the voltages across the voltage divider are selected so that a positive voltage from the output of comparator 602 indicates an abnormal overtemperature condition which sets flip-flop 604 and a positive output from comparator 592 indicates an abnormal under temperature condition which also sets flip-flop 604. The Q output of flip-flop 604 is applied to the multiplexer 536 which periodically samples the flip-flop 604 and applies its output to the central processing unit through input 342. A positive comparison at comparator 588 indicates that the temperature is below the set point and that power should be applied to the heater while a positive comparison at comparator 590 indicates that the temperature is above the temperature set point and that power should be removed from the heater. Thus, in operation, the heater cycles off and on about a set point determined by the resistance of variable resistor 586.

Figure 22:
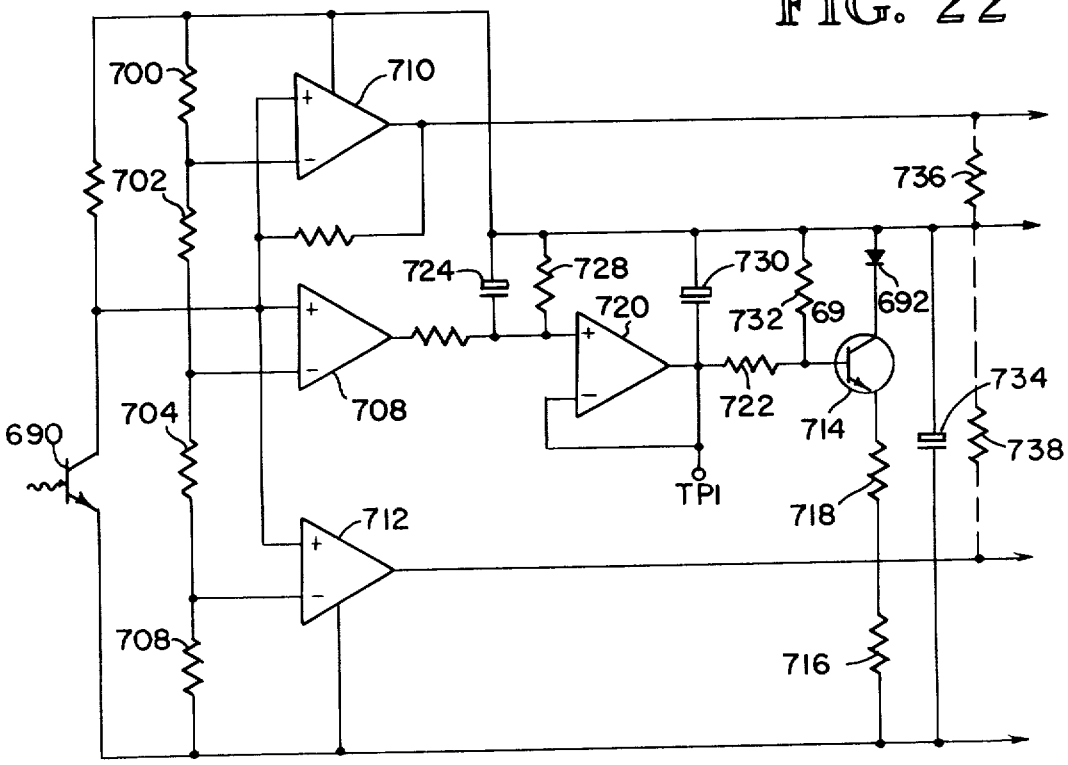
FIG. 22 is a schematic of the circuit receiving the output of the infrared film sensors.

A particular problem associated with sensing the position of the film or holes in the film is that fully exposed film is virtually clear so that the infrared light sensors may receive only about 2% less illumination when the film is present than when the film is absent. Due to aging and effects of ambient temperature on the circuit components it is not practical to use a preset reference voltage to which the output of the sensor is compared since this would require a stability of better than 2%. On the other hand, a circuit which senses relative changes in transmission would be subject to spurious responses when sensing developed film. As illustrated in FIG. 22, the sensor circuit is continuously self-adjusting so that 100% transmission, or the absence of film, corresponds to a precise reference level. This level is rapidly set when transmission is at a minimum and slowly adjusts otherwise. If the transmission is reduced below 100% for an extended period of time the circuit readjusts the reference to a new level. A photo transistor 690 is utilized as the infrared sensor, and a light emitting diode 692 is utilized as the infrared source. Resistors 700, 702, 704, 706 form a voltage divider which produces a reference voltage of approximately two volts at the input to comparator 708, a voltage of approximately 30 millivolts higher at the input to comparator 710 and a voltage of approximately 20 millivolts below the reference at comparator 712. The voltage at the collector of the photo transistor 690 depends on the amount of light received from the diode 692. At 100% transmission, the voltage at the collector is normally maintained at the reference voltage. If the signal voltage increases more than 30 millivolts responsive to a reduction in transmission by more than 1%, the output of comparator 710 goes high indicating that film is present. If the signal voltage becomes more than 20 millivolts negative from the reference voltage the output of comparator 712 goes low for as long as it takes the circuit to establish new reference level indicating that the film has just left the sensor. The output of comparator 710 is utilized in the film mode for sensing the position holes H1, H2 while the output of comparator 712 is utilized in the leader mode for sensing the ends of a leader.

The remainder of the circuitry of FIG. 22 is responsible for maintaining the reference level. This is accomplished by adjusting the driving current through light emitting diode (LED) 692 and correspondingly its brightness. The current through the diode 692 is determined by the voltage at the base of transistor 714 and the resistances of variable resistor 716 and fixed resistor 718. Resistor 716 is normally adjusted only once in order to accomodate variations in light emitting diode and phototransistor characteristics from unit to unit. The base of transistor 714 is connected to the output of comparator 720 through resistor 722. Comparator 720 is an operational amplifier connected as a voltage follower so that the voltage at the output of comparator 720 is equal to the voltage at its positive input. Thus the voltage at the output of comparator 720 is approximately equal to the voltage across capacitor 724. Capacitor 724 functions as a memory for the last 100% transmission reference level. Comparator 708 compares the signal voltage to the reference voltage and if the signal voltage drops below the reference voltage the output of comparator 708 goes low rapidly charging capacitor 724 through resistor 726. If the signal voltage is higher than the reference voltage responsive to the film being present the comparison at comparator 708 is positive the output of comparator 708 floats maintaining the voltage across capacitor 714 which is only slowly discharged by resistor 728. Capacitor 730 stabilizes comparator 720, resistor 732 provides base emitter current for the transistor 714, capacitor 734 stabilizes the supply voltage to the circuit and resistors 736, 738 are pull-up resistors for the opening collector outputs of comparator 710, 712. The outputs of the sensor circuit are applied to the central processing unit 256 to inform the microprocessor of the position of the film F in the film guide 32.

Figure 23:
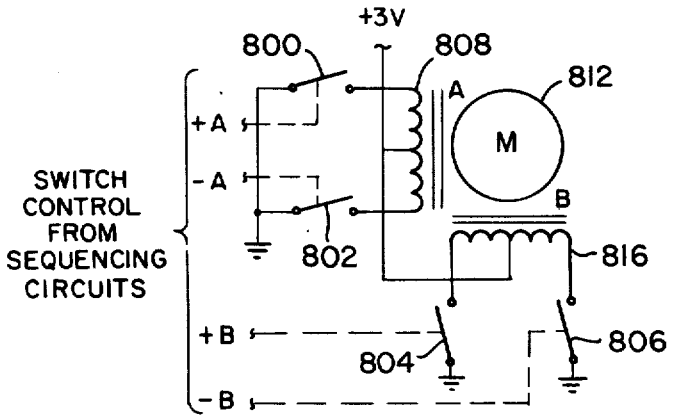
FIGS. 23–25 are schematics illustrating the principle of operation of the motor drive circuitry.

The operation of the circuits for driving the stepper motors is illustrated with reference to FIGS. 23–26. The stepping motors are of the two-phase type as illustrated in FIG. 23. The switches 800–806, which are usually transistors, provide means for producing currents in each winding 808–810 of the motor 812. For example, if switch 800 is closed current flows into winding terminal 2 and out terminal 1 to ground. If switch 802 is closed, current flows into terminal 2 and out of terminal 3 to ground. Since the currents flow in opposite directions in these two cases the magnetic effects on the motor are in opposite directions. The other winding 810 functions in the same manner as the winding 808.

The stepping motor 812 is designed so that if the switches 800–806 are opened and closed in the sequence shown in the table of FIG. 3 the motor 812 turns a half step at a time. The motor movement occurs immediately after each change of switch configuration. If the pattern is repeated every four steps the motor will continue to move. If the pattern is produced in reverse, the motor moves in the opposite direction. A full step sequence which deletes the $Y_2$ step positions from the table is often used.

Note that the motor always has some current flowing through it when one of the switches 800–806 is closed even when the motor is stopped.

The principal disadvantage of the circuit of FIG. 23 is that the applied voltage, in this case three volts, is the voltage which causes the motor's rate of current to flow through the motor winding resistance. The problem arises when an attempt is made to run the motor at high speed. Since the motor winding is inductive, the current does not immediately increase to its rated value when one of the switches 800–806 is closed. Since it is current which produces magnetic effects and hence torque, the torque and even the ability of the motor to run at high speed is very limited with the circuit of FIG. 23.

Figure 24:
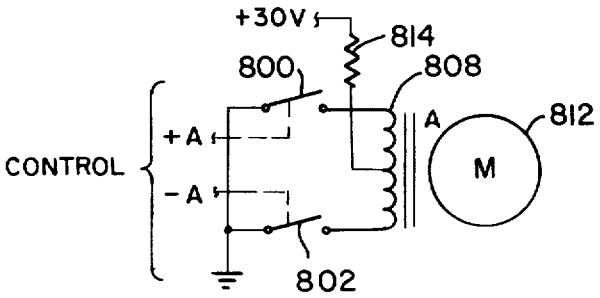

The circuit of FIG. 24 places a resistor 814 in the supply path to produce a "current source" effect. In other words, the full voltage is applied across the windings when the switches 800, 802 are initially closed since the current through the resistor 814 is zero. However, as current begins to flow through the resistor 814 the voltage across the winding 808 decreases because of the voltage drop across the resistor 814. The principal disadvantage of this circuit is the power dissipated in the resistor 814. Since the applied voltage must be much greater than the maximum voltage across the winding 808, most of the power applied to the circuit is dissipated in the resistor 814.

Figure 25:
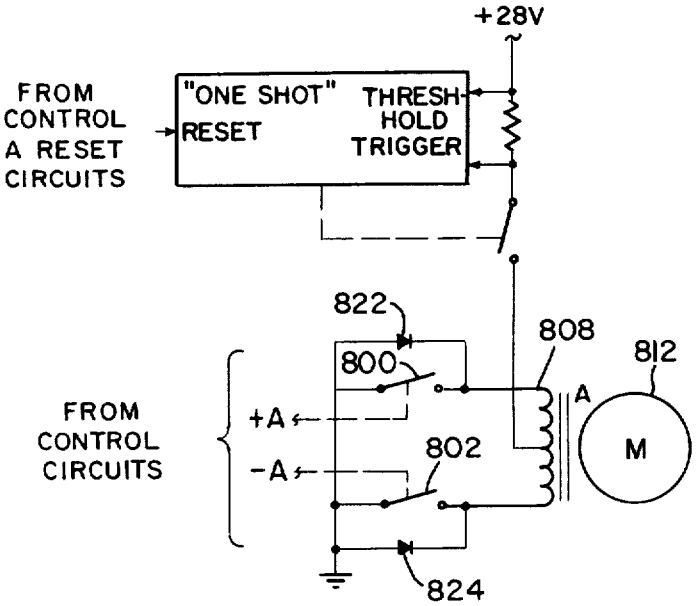

With reference to FIG. 25, the switches 800, 802 continue to control the direction of current in the motor winding 808 according to control signals +A, −A as shown in the sequence table. Also, like the circuit of FIG. 24, the voltage applied to the motor 812 initially is substantially higher than the rated voltage which causes currents to build up in the winding 808 very rapidly to provide good high speed performance. However, the resistor 816 placed in series between the supply voltage and the winding 808 is much lower resistance than the resistor 814 utilized in the circuit of FIG. 24. To avoid excessive currents in the motor winding 808 switch 818 is placed in series with the resistor 816. The switch 818 is controlled by a one-shot 820 which monitors the current through resistor 816 and opens switch 818 momentarily whenever the winding current reaches its rated value. Diodes 822, 824 provide paths to ground for the winding currents when the switch 818 is opened. In operation, switch 818 may be opened and closed several thousand times a second providing a chopper regulation of the winding currents. At very high speed the motor currents never reach their rated values and the voltage drop across resistor 816 is not sufficient to trigger the one-shot. In these circumstances switch 818 remains closed applying maximum voltage to the motor during each step.

If the motor 812 was stopped either switch 800 or switch 802 may be closed. Assuming that switch 800 is closed and switch 818 has just closed, the winding current will be less than its rated value and since the winding is inductive, the applied voltage between terminals 2 and 1 of winding 808 remains constant for a short period of time. As the current increases the voltage drop across resistor 816 increases and when it reaches a voltage corresponding to the rated current of the motor 812 the one-shot 820 fires. The one-shot opens switch 818 for the duration of its period.

During the time switch 818 is on, winding terminal 1 is at ground, terminal 2 is at the applied voltage and, due to the transformer action in the winding 808 between terminals 2 and 3, terminal 3 is at about twice the applied voltage. When switch 818 opens the inductive action of the winding causes terminals 2 and 3 to go negative and diode 824 to turn on. A current then flows from ground through diode 824 from terminal 3 to terminal 1, through switch 800 and back to ground. This circulating current, although only half the original current from terminals 2 to 1, flows through the entire winding 808 and thus has the same magnetizing effect in the motor. Consequently, although the voltage across the winding 808 and the currents in the two halves of the winding 808 oscillate as the switch 818 opens and closes, the magnetizing effect in the motor corresponds to the effect of a relatively constant current approximately equal to the full rate of current flowing through the winding 808.

When the stepping motor 812 was called upon to operate at an intermediate stepping speed the operation as described above must be varied somewhat. At intermediate speeds it is possible for the switch 818 to be opened during the period that switch 800 closes and switch 802 closes. Under these circumstances no voltage is applied to the motor until the period of the one-shot 820 has elapsed. To avoid this problem, a reset is applied to the one-shot 820 when both switches 800, 802 are open insuring that the switch 818 is closed whenever switches 800, 802 are initially closed.

Figure 26:
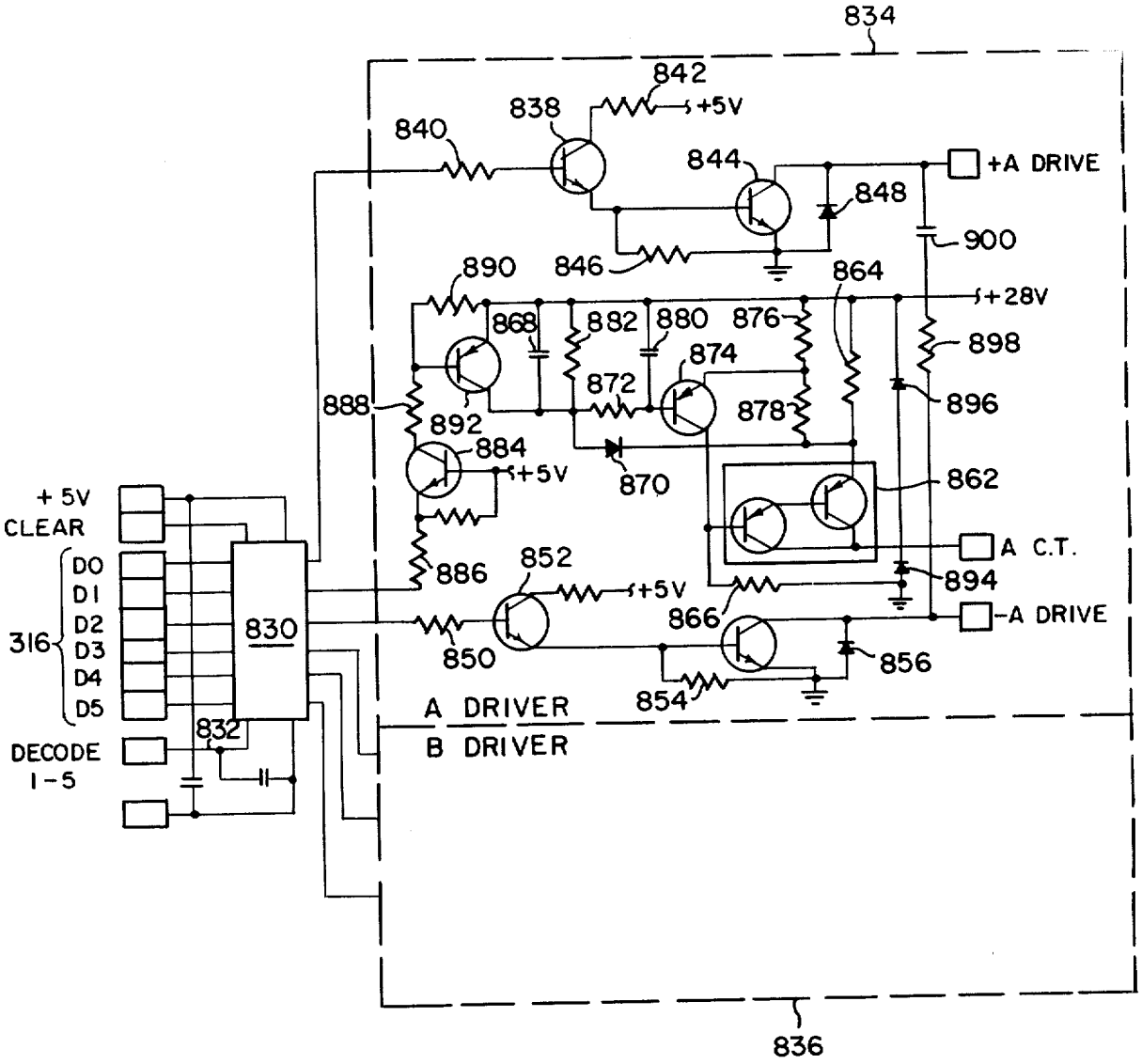
FIG. 26 is a schematic of the motor drive circuitry.
Figure 27:
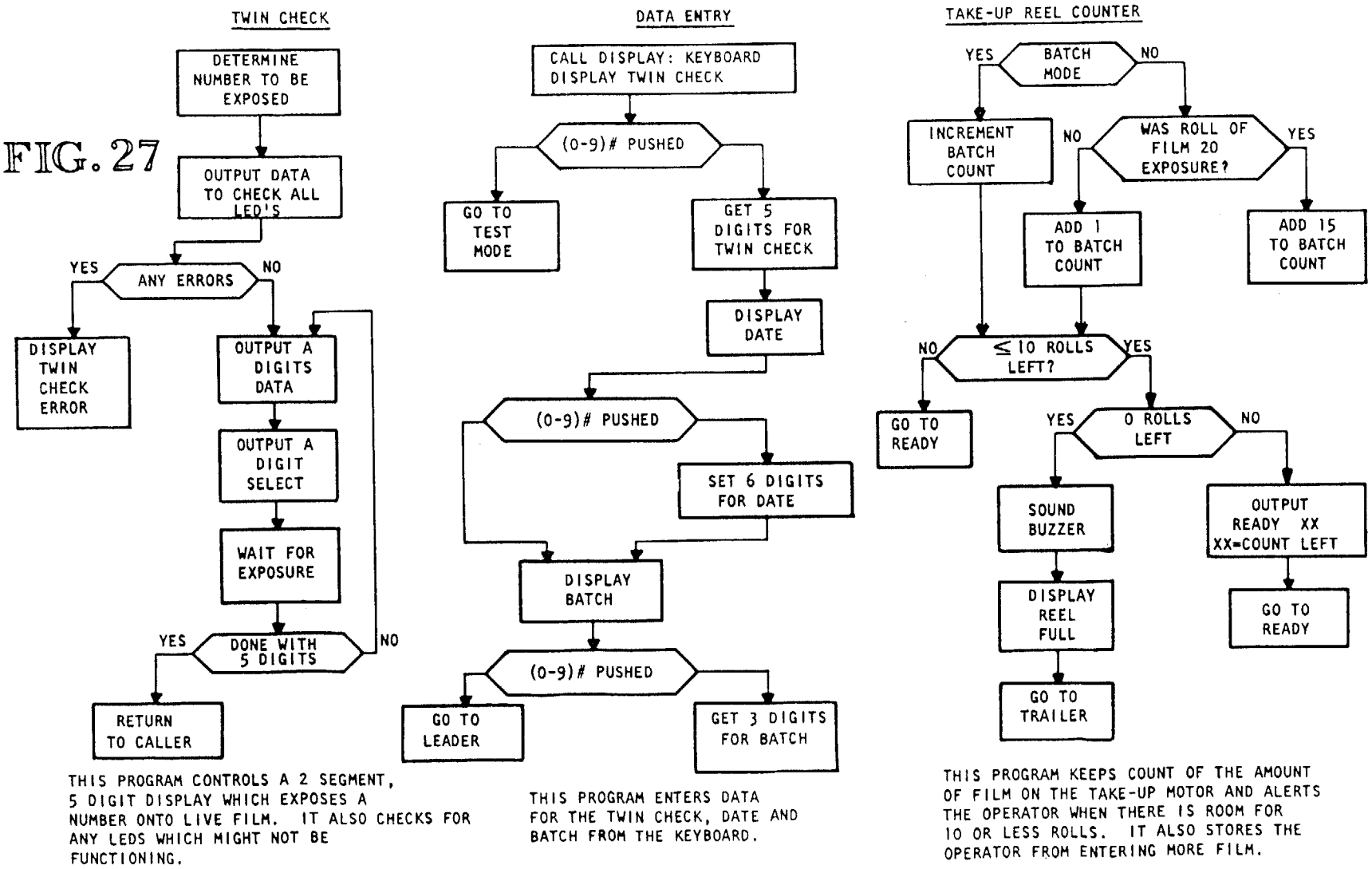
Figure 28A:
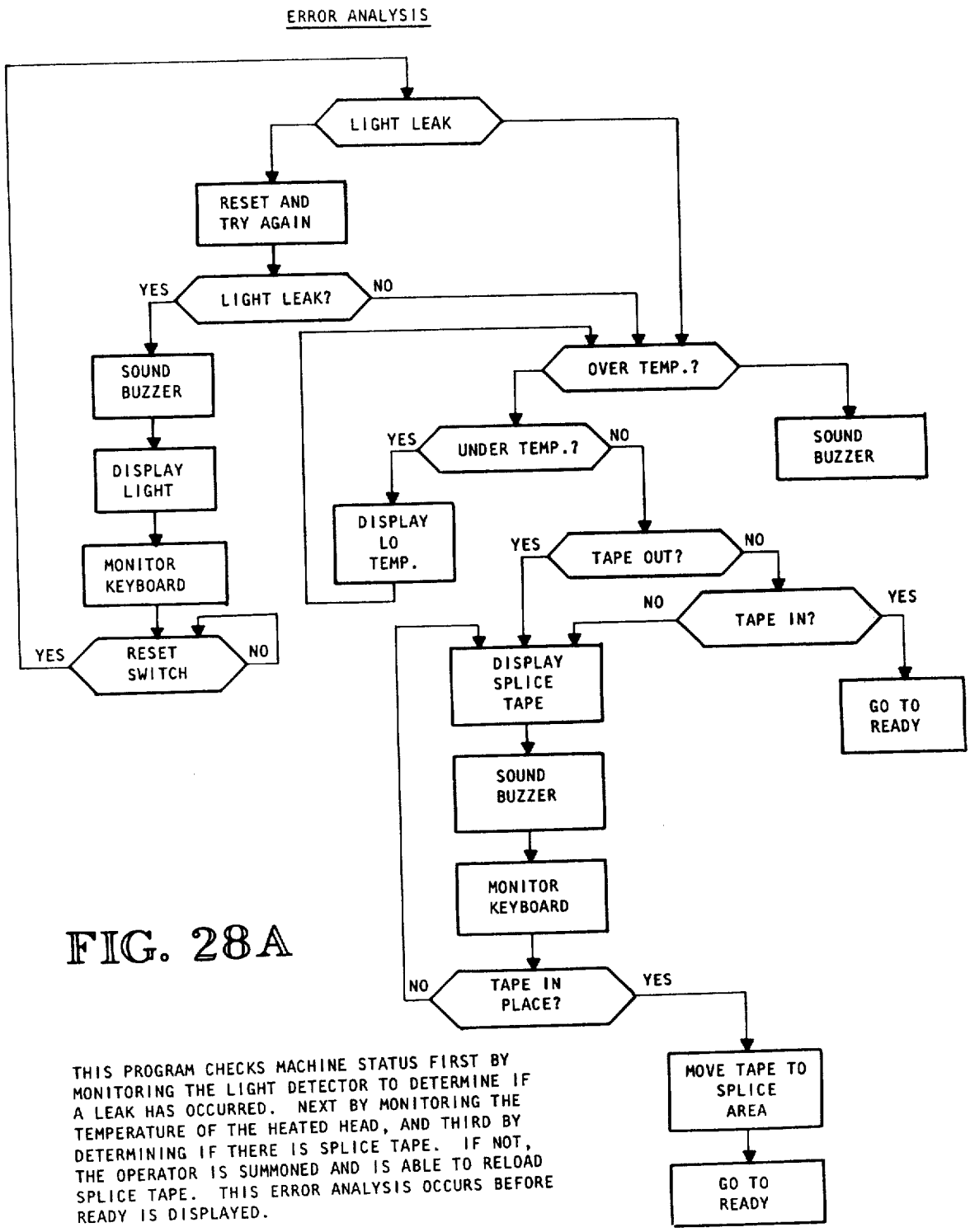
Figure 28B:
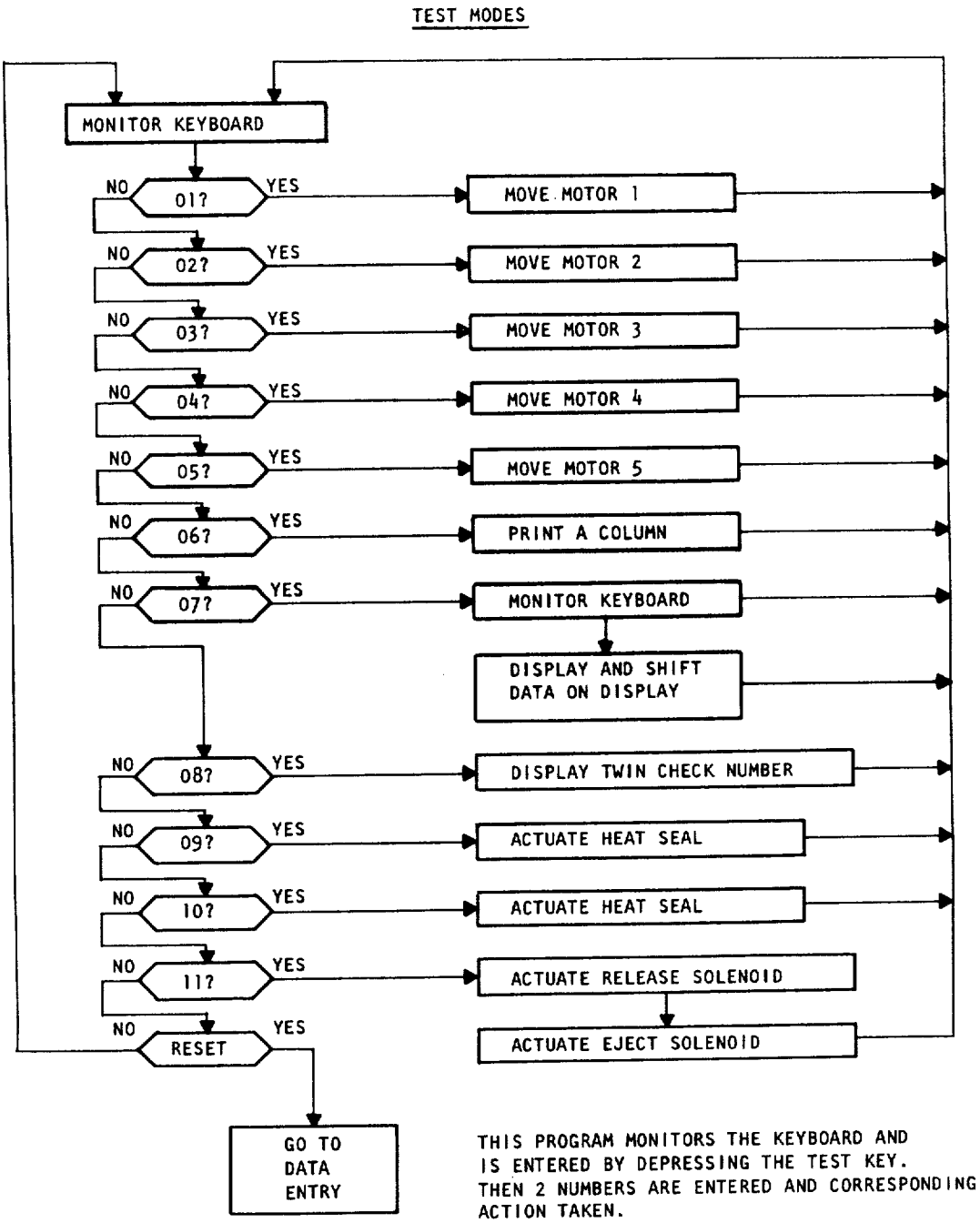
Figure 29A:
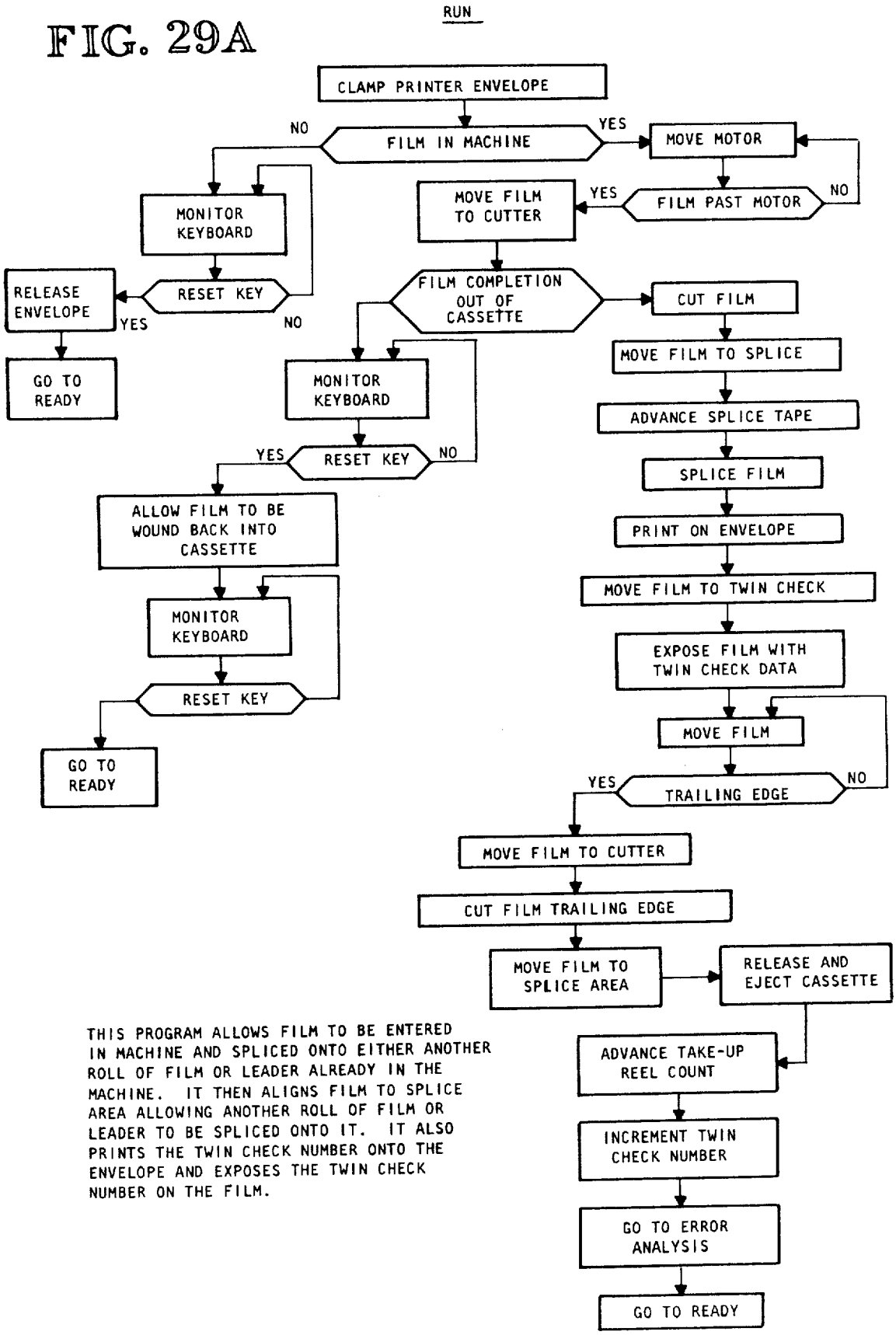
Figure 29B:
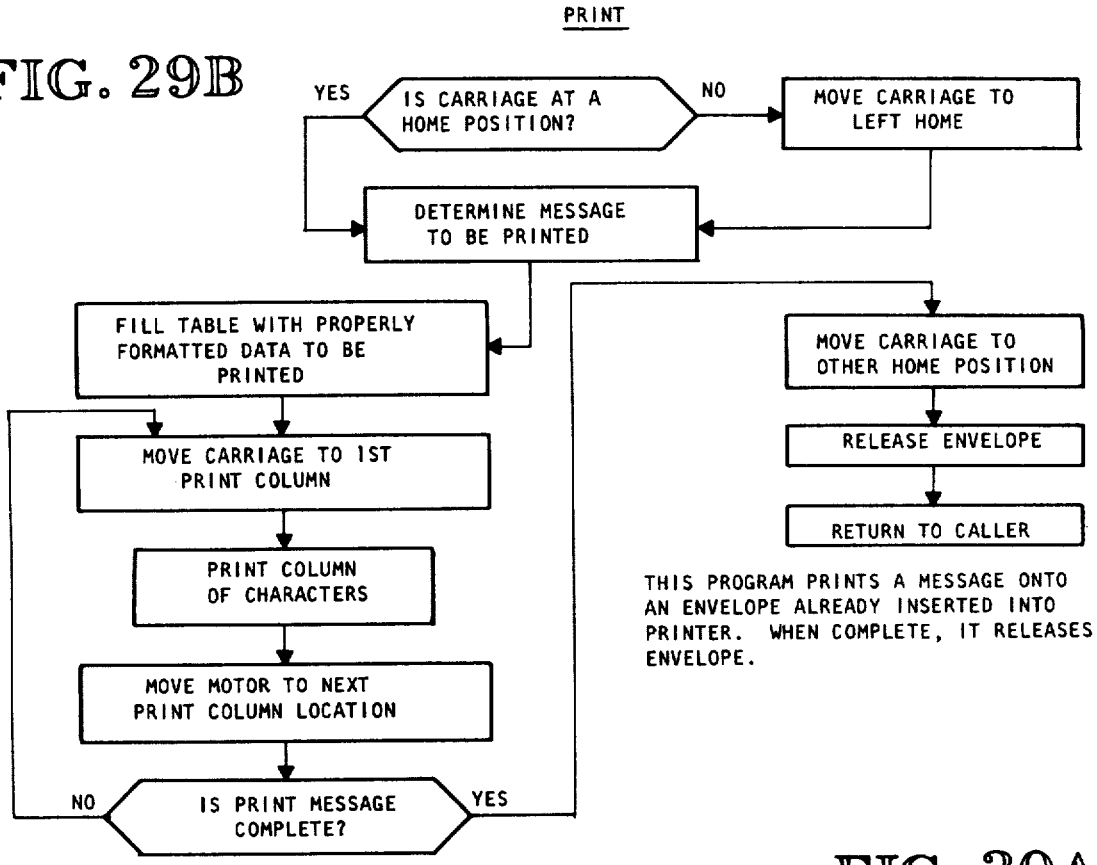
Figure 30A:
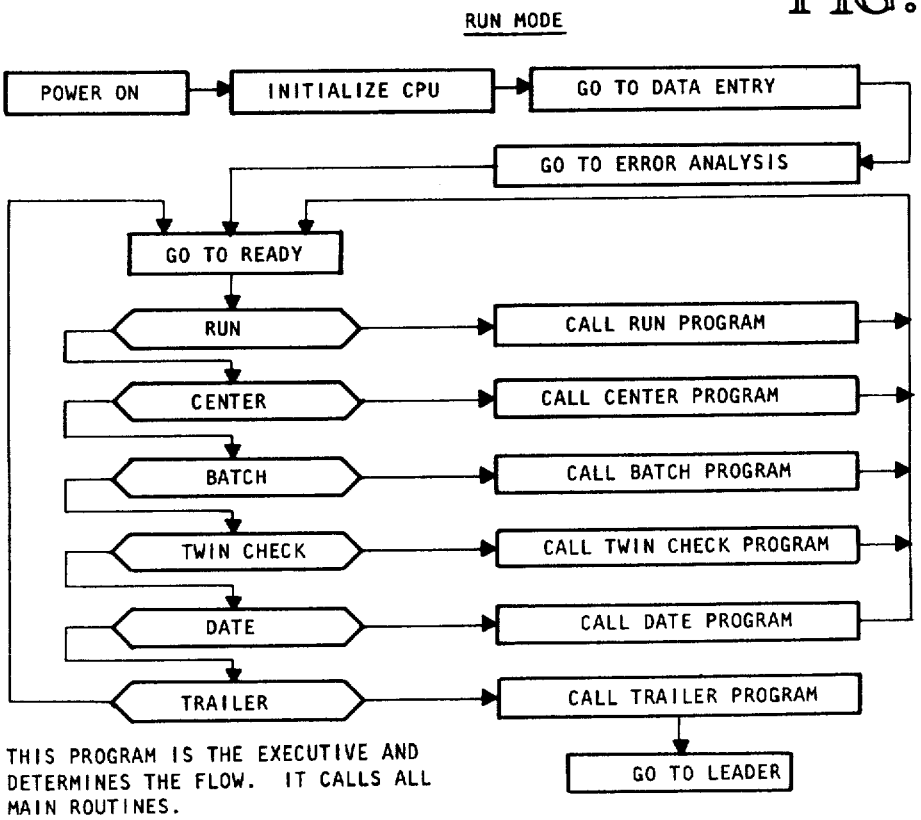
Figure 30B:
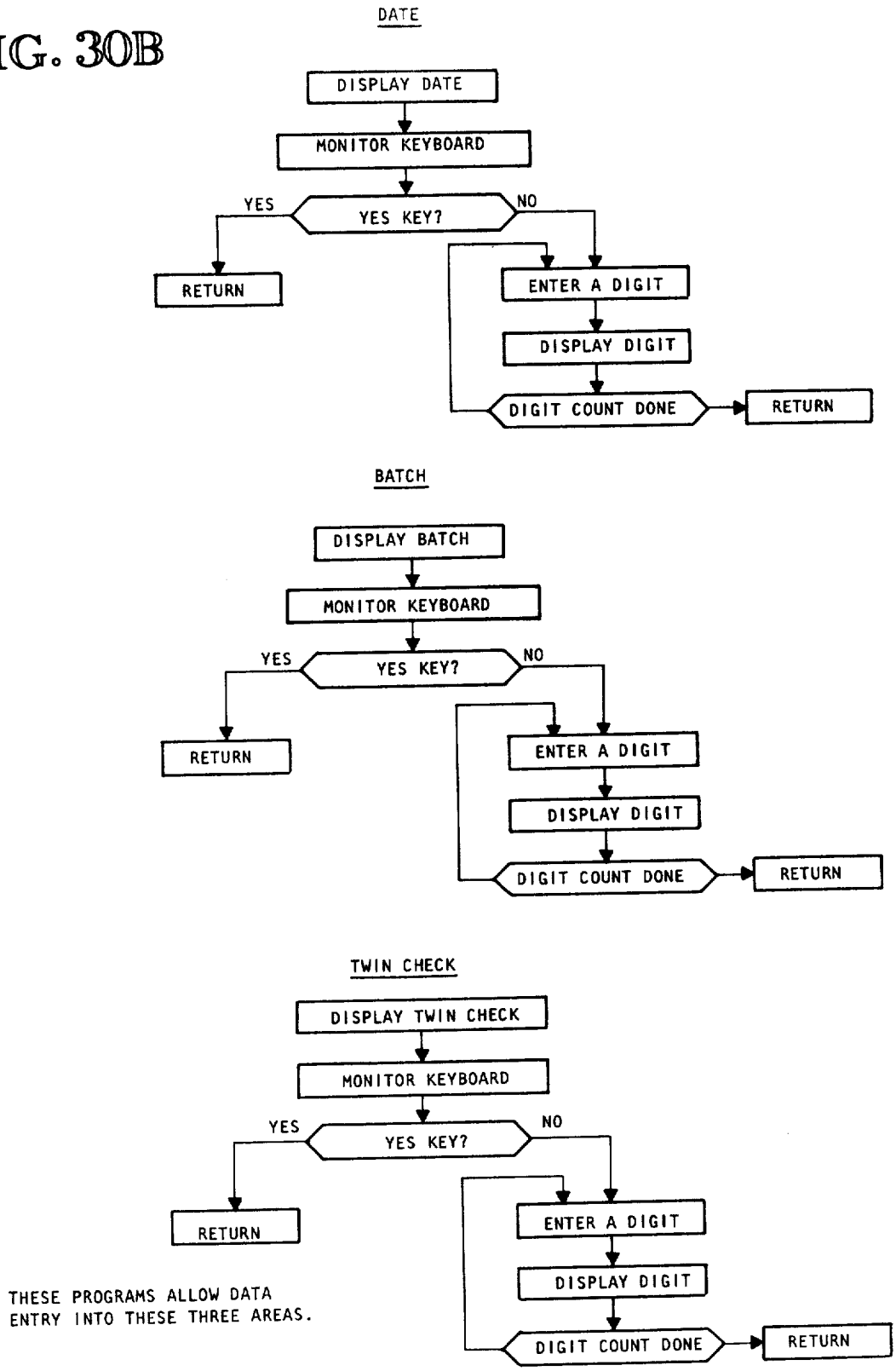
Figure 32A:
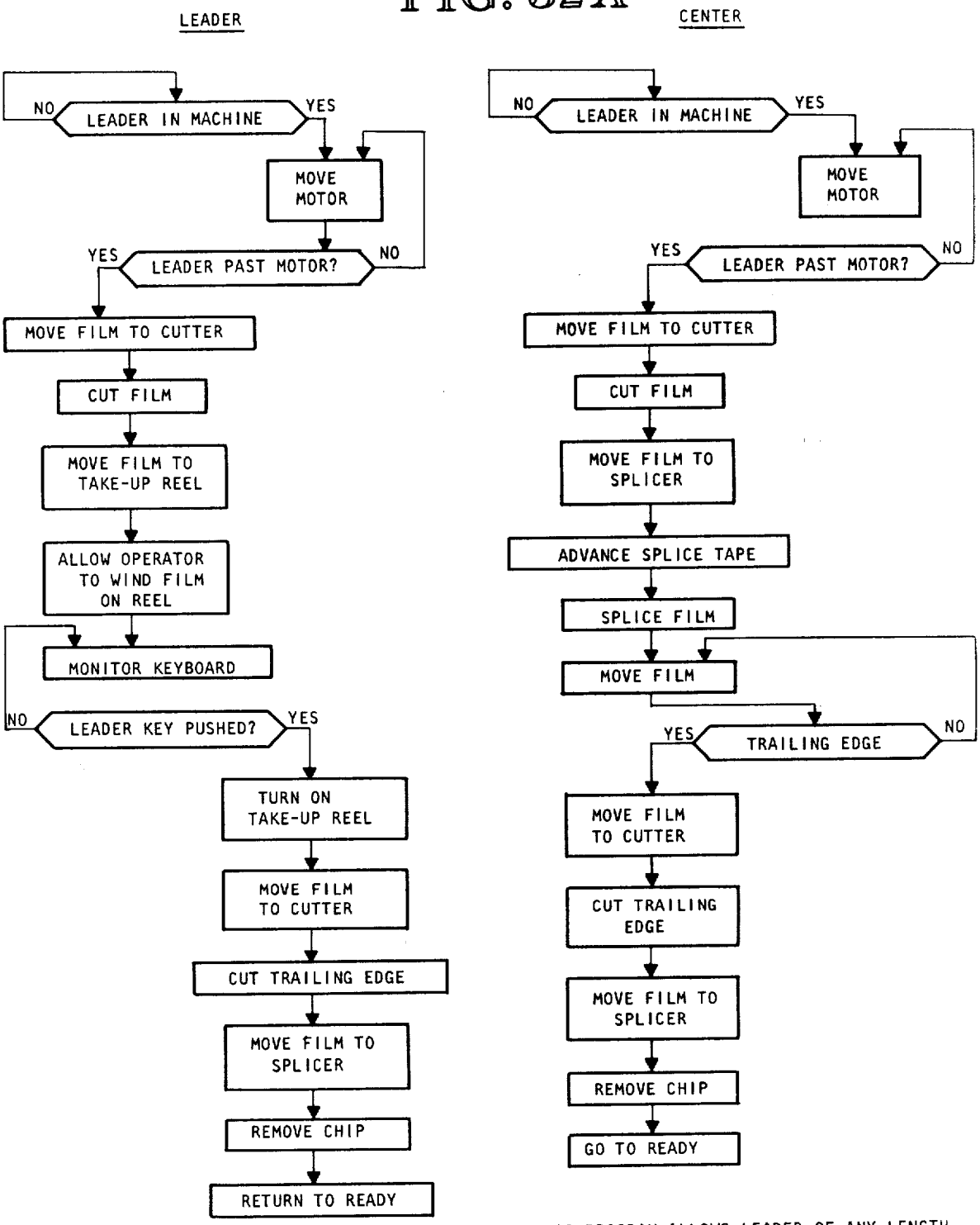
Figure 32B:
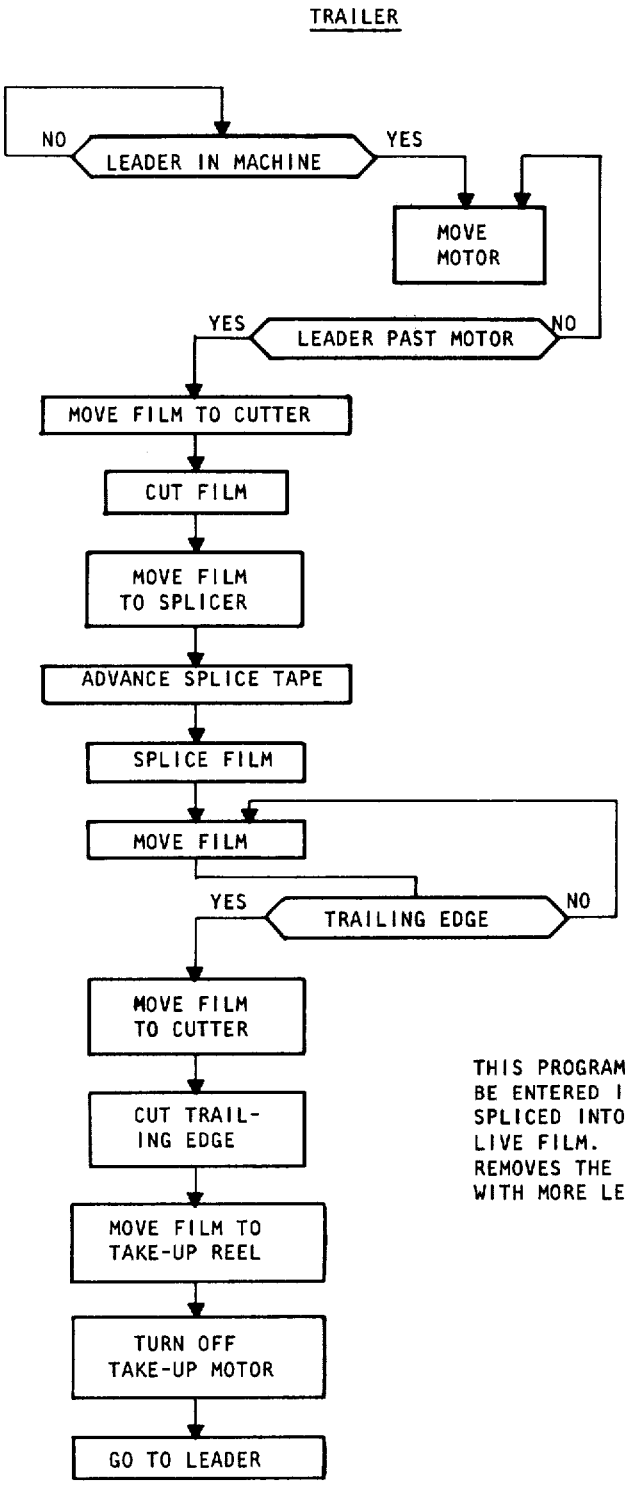

The stepper motor circuitry utilized in the film splicer as illustrated in FIG. 26 utilizes the principles described above. The sequence of control signals shown in the tables of FIGS. 24, 25 are produced on the data output lines 316 by the central processing unit and recorded in a latch 830 responsive to a signal on line 832. The latch 830 applies properly sequenced pulses to two identical circuits 834, 836. When the latch 830 applies a logic high to transistor 838 through resistor 840 current flows through resistor 842 and the collector emitter junction of transistor 838 to saturate transistor 844 which is normally held at cutoff by resistor 846. A diode 848 placed across the collector and emitter of transistor 844 performs the same function as diodes 822, 824 of FIG. 25. Thus components 838–848 perform the function of switch 800 of the circuit illustrated in FIG. 25. Similarly, resistor 850, transistor 852, resistor 854, transistor 856 and diode 860 perform the function of switch 802 of the circuit illustrated in FIG. 25.

Darlington pair 862 is switched to selectively apply power to the motor and thus corresponds to switch 818 of FIG. 25. All of the current supplied to the motor flows through resistor 864, and the voltage across resistor 864 is measured to determine the current supplied to the motor. Darlington pair 862 is normally saturated by current flowing through resistor 864 and resistor 866. Assuming that capacitor 868 is discharged, current flowing through resistor 864 charges capacitor 868 through diode 870. When the voltage drop across resistor 864 approaches the full rated voltage of the motor enough current flows through resistor 872 to drive transistor 874 out of cutoff thereby raising the voltage on the base of darlington pair 862. As darlington pair 862 starts to turn off and the voltage across resistor 864 begins to decrease due to the voltage divider action of resistors 876, 878 the emitter of transistor 874 goes more positive turning transistor 874 on harder. This positive feedback action, with the aid of capacitor 880 holding the voltage on the base of transistor 874 constant, further increases the switching of transistor 874 and rapidly drives darlington pair 862 to cutoff. Capacitor 868 is now discharged by resistor 882 and the current through resistor 872 and transistor 874. The period of the one-shot is determined by the time it takes capacitor 868 to discharge to the point where transistor 874 turns off. As transistor 874 turns off, darlington pair 862 turns back on to once again repeat this cycle. When the latch 830 applies a logic low to the emitter of transistor 884 through resistor 886, transistor 884 turns on causing current to flow through resistor 888. As current flows through resistor 890 the base emitter junction of transistor 892 becomes forward biased thereby turning transistor 892 on to discharge capacitor 868 and turn darlington pair 862 on. Diode 894 is provided to suppress transients which might conceivable exceed the breakdown voltage of darlington pair 862. Diode 896 is provided to suppress transients which might reverse bias darlington pair 862. Resistor 898 and capacitor 900 form a transient suppression network which prevents transistors 844 and 858 from being subjected to narrow pulses in excess of their breakdown voltage.

A flow chart for controlling the operation of the splicer in accordance with the operation as described above is illustrated in FIGS. 27–32 nd is self explanatory.

The embodiments of the invention in which an exclusive property or privilege is claimed are defined as follows:

1. A film strip splicing machine comprising, guide means for guiding a film strip along a predetermined travel path from a film entry to a spliced film storage container, reciprocating film cutting means at a cutting station along the travel path for cutting off a lead end portion of the film strip in a first cutting direction and for cutting off a trailing end portion of the film strip in a reverse cutting dirction, film splicing means at a splicing station further along the travel path than the cutting station for splicing the cut lead end of one film strip to the cut trailing end of another, first drive means between the entry and the cutting station for advancing each film strip through the cutting station to the splicing station, second drive means between the splicing station and the storage container for advancing spliced film strips to said container, control means operatively associated with the cutting means, splicing means, and first and second drive means for automatically activating and deactivating them in a predetermined sequence whereby each film strip has its lead end cut off at the cutting station and the fresh-cut lead end thereof advanced to the splicing station and spliced to the trailing end of a film strip in front thereof, and whereby the two spliced films are then advanced together until the trailing film strip has had a trailing end portion cut off at the cutting station and the fresh-cut trailing end thereof advanced to the splicing station, and housing means for making said travel path, two drive means, and two stations free of light.

2. A film strip splicing machine according to claim 1 in which the film is undeveloped photographic film and further including a numbering means located along the travel path for exposing a respective identification number on each film strip.

3. A film strip splicing machine according to claim 2 further including a number applying means operatively associated with said numbering means for simultaneously printing on a respective envelope for the film strip the same identification number exposed on the film strip.

4. A film strip splicing machine according to claim 1 wherein said film strip is of the type contained in a film cartridge in which the film and a backing tape are wound together on a take-up reel, said cartridge having a slot from which an end portion of said backing tape extends to be gripped for unwinding the film from said take-up reel through the slot by pulling on said end portion of said backing tape whereupon the coil set of the film causes the film strip to curl and separate from the backing tape as said backing tape and said film move away from said slot, and further, in which said housing means includes a downwardly curved entry portion, said splicing machine further including:

cartridge mounting means for mounting said film cartridge on said housing below the mouth of said entry portion in a position wherein the curl of said film strip as it is unwound from the cartridge take-up reel generally corresponds to the curve of the entry portion such that the film strip will enter and travel along said entry portion and further along said travel path responsive to unwinding of said film by pulling on said backing tape, said cartridge mounting means including a light shield for protecting said film from light as it moves from said reel into said entry portion.

5. A film strip splicing machine in accordance with claim 4 wherein said film cartridge is of the type in which the take-up reel has an exposed driving gear associated therewith, said film splicing machine further including:

rewind means associated with said housing, said rewind means having a reversing gear selectively engageable with said driving gear of said take-up reel when said cartridge is mounted on said housing, and reversing gear driving means associated with said reversing gear and operable for turning said reversing gear to rewind said film strip on said take-up reel after said film has been partially unwound from said take-up reel and said unwound portion has entered said film strip splicing machine.

6. The splicing machine of claim 4 wherein said housing includes:

a light-free film storage zone located in said housing above a portion of said travel path such that said film strip can curve upwardly into said storage zone when the lead end of said film strip has passed along said travel path beyond said storage zone and is stopped while the remainder of said film is entering said travel path as it is unwound from the cartridge, and a lightweight gravity-closing gate in said housing overlying the portion of said travel path at the underside of said film storage zone, said closing gate being pivotally mounted on said housing at the front and bottom of said storage zone so as to lift open responsive to the curving up of said film strip.

7. The film splicing machine according to claim 6 wherein said light-free storage zone is located along said film travel path between said entry portion and said cutter means.

8. The film strip splicing machine according to claim 1 further including:

feed means for feeding a splicing tape at cross angles to said travel path from one side thereof at said splicing station to bring an end portion of said tape in overlapping relation to one face of the trailing end portion of one film strip and a contiguous leading end portion of another film strip, a stop shoe associated with said housing and located at said splicing station for opposing motion of one face of said film strips, a stationary shearing plate located at said splicing station having a tape shearing edge thereon adjoining one longitudinal side of the travel path of said film strip, a movable heated shoe at the splicing station arranged to press said tape and said film strips against said stop shoe during a pressure stroke of said movable heated shoe to bond said tape and said film strip together, said movable shoe having a shearing edge cooperating with the shearing edge of the shearing plate to cut off the overlapping portion of said tape as the heated shoe moves toward the stop shoe, and actuating means connected to said heated shoe for selectively moving said shoe in said pressure stroke and in a return stroke.

9. A film strip splicing machine in accordance with claim 8 further including:

warning means for generating a first signal in response to a trailing end of said splicing tape being a predetermined distance from said travel path, and second control means responsive to said first signal for reversing said feed means to withdraw said splicing tape from said travel path.

10. A film strip splicing mechanism according to claim 8 in which said first drive means includes:

a first stepper motor mounted on said housing, and a first drive roller coupled in driven relationship to said first stepper motor and engageable with said film strip for conveying said film strip along said travel path from said entry through said cutting station and to said splicing station.

11. A film strip splicing machine in accordance with claim 10 wherein said second drive means includes a second stepper motor and a second drive roller mounted on said housing in driven relationship to said second stepper motor and engageable with said film strip for advancing said film strip after splicing along the travel path from said splicing station to said storage container.

12. In a film strip splicing machine for splicing a film strip from a film cartridge of the type in which the film and a backing tape are wound together on a takeup reel having a slot from which an end portion of the backing tape extends to be gripped for unwinding the film from the reel through the slot by pulling on said end portion whereupon the coil set of the film causes the film strip to curl and separate from the backing tape as they move away from the slot, a housing providing an elongated light-free film travel path having a downwardly curved entry portion at the rear, cartridge mounting means for mounting a film cartridge on the housing below the mouth of said entry portion in a position wherein the curl of the film strip when being unwound from the cartridge takeup reel generally corresponds to the curve of the entry portion whereby the film strip will enter and travel along said entry portion and further along the travel path responsive to unwinding of the film by pulling on the backing tape, said cartridge mounting means including a light shield for protecting the film from light as it moves from the reel into said entry portion, a light-free film storage zone located in said housing above a portion of said travel path constructed and arranged such that a film strip can belly up into the storage zone when the lead end of the film has passed along the travel path beyond the storage zone and is stopped while the remainder of the film is entering the travel path as it is unwound from the cartridge, and a lightweight gravity-closing gate in the housing overlying the portion of the travel path at the underside of the film storage zone and pivotally mounted at the front and bottom of the storage zone so as to lift open responsive to bellying up of the film strip.

13. A splicing machine according to claim 12 further including first drive roller means located along said travel path for advancing the film strip in a first direction as it enters the entry portion, cutter means located along the travel path for cutting off the lead end and trailing end of the film strip, splicing means located along the travel path for splicing the trailing end of one film strip to the leading end of the next, and second drive roller means located along said travel path for selectively advancing the spliced film strips in said first direction.

14. A film strip splicing mechanism comprising, guide means for guiding a film strip along a predetermined travel path in a first direction, feed means for feeding a splicing tape at cross-angles to said travel path from one side thereof at a splicing station to bring a leading end portion of the tape in overlapping relation to one face of the trailing end portion of one film strip and the contiguous leading end portion of another film strip, a stop shoe at the splicing station for opposing one face of said film strips, a stationary shearing plate at the splicing station having a tape shearing edge adjoining one longitudinal side of the travel path of the film strip, a movable heated shoe at the splicing station arranged to press said tape and film strips against said stop shoe during a pressure stroke to bond the tape and film strip together, said heated shoe having a shearing edge cooperating with the shearing edge of the shearing plate to cut off the overlapping portion of the tape as the heated shoe moves toward the stop shoe, actuating means connected to said heated shoe for selectively moving it in said pressure stroke and in a return stroke, warning means activated when a trailing end of said splicing tape is a predetermined distance from said travel path; and control means operable to reverse said feed means to withdraw the splicing tape from said travel path.

15. A film strip splicing mechanism according to claim 14 further including first drive roller means associated with said guide means and powered by a first stepper motor for conveying a spliced film strip along the travel path, film cutting means at a cutting station spaced from said splicing station in a direction opposite said first direction for cutting each end of each film strip prior to splicing said film strip, and control means connected to the film cutting means and the first drive roller means for energizing said first stepper motor for a period sufficient to advance the cut trailing end of each film strip to the splicing station.

16. A film strip splicing mechanism according to claim 15 further including a second drive roller means associated with said guide means and powered by a second stepper motor for advancing a film strip along the travel path in said first direction through the cutting station to the splicing station, said control means being connected to said second drive roller means and said film cutting means to activate the cutting means to cut off a lead end portion of the advancing film strip and to deenergize the second drive roller means when the fresh-cut leading end of the film strip reaches the splicing station.

17. In a film strip splicing machine for splicing a film strip from a film cartridge of the type in which the film and a backing tape are wound together on a takeup reel, said takeup reel having an exposed driving gear, said cartridge having a slot from which an end portion of the backing strip extends to be gripped for unwinding the film from the reel through the slot by pulling on said end portion whereupon the coil set of the film causes the film strip to curl and separate from the backing tape as they move away from the slot, a housing providing an elongate light-free film travel path having a downwardly curved entry portion, cartridge mounting means for mounting a film cartridge on the housing below the mouth of said entry portion in a position wherein the curl of the film strip when being unwound from the cartridge takeup reel generally corresponds to the curve of the entry portion whereby the film strip will enter and travel along said entry portion and further along the travel path responsive to unwinding of the film by pulling on the backing tape, said cartridge mounting means including a light shield for protecting the film from light as it moves from the reel into said entry portion, means for selectively engaging said driving gear with a reversing gear when the cartridge is mounted on the housing whereby the film strip can be rewound on the takeup reel after the film strip has been partially unwound from the takeup reel, and means for turning said reversing gear.

* * * * *